US007337596B2

(12) United States Patent
Barrett et al.

(10) Patent No.: US 7,337,596 B2
(45) Date of Patent: Mar. 4, 2008

(54) MANUAL CAPSULE LOADING MACHINE AND METHOD

(75) Inventors: Dene Barrett, P.O. Box 605, Frazier Park, CA (US) 93225; Earle Wilkins, Helendale, CA (US)

(73) Assignee: Dene Barrett, Frazier Park, CA (US)

( * ) Notice: Subject to any disclaimer, the term of this patent is extended or adjusted under 35 U.S.C. 154(b) by 40 days.

(21) Appl. No.: 11/297,239

(22) Filed: Dec. 9, 2005

(65) Prior Publication Data

US 2007/0130890 A1 Jun. 14, 2007

(51) Int. Cl.
*B65B 35/56* (2006.01)

(52) U.S. Cl. ..... 53/531; 53/390; 53/544; 53/900

(58) Field of Classification Search ..... 53/900
See application file for complete search history.

(56) References Cited

U.S. PATENT DOCUMENTS 803,145 A * 10/1905 Winchester ..... 53/367
1,993,716 A * 3/1935 Hanley et al. ..... 53/281
4,089,152 A 5/1978 Zanasi
4,343,130 A 8/1982 Facchini
4,405,049 A 9/1983 Deitz
4,615,165 A 10/1986 Gamberini
4,724,019 A 2/1988 Brown et al.
4,731,979 A 3/1988 Yamamoto et al.
4,761,932 A 8/1988 Harvey et al.
4,802,323 A * 2/1989 Garris et al. ..... 53/53
4,884,602 A 12/1989 Yamamoto et al.
4,901,865 A 2/1990 Staples (Continued)

OTHER PUBLICATIONS

Operating Guide for C05 Capsule Filling Apparatus, Tashi Enterprises, 1 page.
Chapter 45 "Oral Solid Dosage Forms", Capsules, pp. 885, 886, 888.
Remington's Pharmaceutical Sciences, 14th Edition, Mack Publishing Co., 1970, pp. 1671-1680.
USP 26, (1151) Pharmaceutical Dosage Forms, Capsules, pp. 2399-2400.

*Primary Examiner*—John Sipos
(74) *Attorney, Agent, or Firm*—Cislo & Thomas, LLP

(57) ABSTRACT

A capsule orienting and separation apparatus is provided which allows a multiplicity of gelatin capsule shells to be uniformly oriented in a separable condition and for the caps of those shells to be separated from the capsule bodies. The apparatus allows a multiplicity of capsule shells all to be concurrently oriented in an upright disposition by a manually operated mechanism. The capsule caps are all uniformly oriented atop the capsule bodies and are exposed for gripping by a capsule cap lift assembly. The capsule caps are concurrently lifted from the capsule bodies while the capsule bodies remain in position in a matrix of openings in a capsule receiving tray. The capsules can then be filled with capsule filler material and tamped down as appropriate. The capsule caps are then all concurrently replaced on the capsule bodies and the capsule caps and capsule bodies are then concurrently permanently sealed together. All of the steps of orientation, filling, and sealing are performed with a manually operable mechanism.

11 Claims, 27 Drawing Sheets

U.S. PATENT DOCUMENTS

| | | | | |
|---|---|---|---|---|
| 4,959,943 | A | 10/1990 | Yamamoto et al. | |
| 4,964,262 | A | 10/1990 | Moser et al. | |
| 5,074,102 | A | 12/1991 | Simpson et al. | |
| 5,081,822 | A | 1/1992 | Boyd et al. | |
| 5,417,030 | A | 5/1995 | Ribani et al. | |
| 5,836,141 | A * | 11/1998 | Sundberg | 53/468 |
| 2004/0144066 | A1 * | 7/2004 | Piemontese | 53/485 |

* cited by examiner

MANUAL CAPSULE LOADING MACHINE AND METHOD

BACKGROUND OF THE INVENTION

1. Field of the Invention

The present invention relates to a machine useful for concurrently aligning a multiplicity of capsule shells in preparation for separation of the capsule caps from the capsule bodies, concurrent removal of the capsule caps from the capsule bodies, and concurrent replacement and sealing of the capsule caps on the capsule bodies once the capsule bodies have been filled with the desired substance.

2. Description of the Prior Art

Many different medications and vitamin and mineral supplements are orally administered in the form of gel capsules that dissolve in the human body once ingested. Gel capsules are manufactured in several standardized sizes and include capsule shells, each comprised of a capsule cap that slides onto the end of a capsule body. Conventional capsule shells are oblong in shape, having rounded ends, and vary in size from a small fraction of an inch to slightly over an inch in length. Both the caps and the cylindrical bodies of conventional gel capsule shells have a circular, annular cross section.

During the manufacture of the capsule shell components the walls of each capsule body are deformed by creating a shallow, annular, radial groove in the outer wall surface a short distance from the open, circular mouth of the capsule body. The capsule caps are each deformed to create a mating, radially inwardly projecting ring on their inner wall surfaces near their closed extremities. As shipped, the capsule shells are still separable so that they can be filled with a medical composition, vitamins, and/or minerals with the cap of each capsule shell telescopically fitted onto the mouth of the capsule body so that the capsule shell is provided in the form of a closed unit.

As provided by capsule shell manufacturers, the capsule cap is telescopically fitted onto the capsule body to only a limited extent, so that a longitudinal gap exists between the radially inwardly projecting ring on the inner wall of the capsule cap and the corresponding radial groove formed in the outer wall of the capsule body. Consequently, the capsule cap can be easily separated from the capsule body in order for the capsule body to be filled with the desired substance.

Once the medication or other powdered, granular, or liquid material has been placed in the capsule bodies, the caps of the capsule shells are concurrently replaced on to the open mouths of the capsule body shells. The caps and the bodies are then concurrently pressed toward each other a sufficient distance so that the annular, radially inwardly protruding ring on each capsule cap engages the outwardly facing annular groove on the outer wall of a capsule body. The capsule caps are thereupon inextricably sealed onto the capsule bodies.

Very sophisticated, expensive capsule shell manipulation machines exist for the mass production of capsules containing medication, vitamins, minerals, and other substances. Such machines are described, for example, in U.S. Pat. Nos. 5,081,822; 4,884,602; 4,964,262; 4,731,979; 4,761;932; and 5,074,102. The prior art machines depicted in these patents are exemplary only, as numerous other devices exist for the mass production of filled capsules. However, the foregoing devices share a common characteristic of very substantial expense in capital equipment for the machinery required and constant monitoring. The cost of such conventional systems can be justified only where extremely high volumes of capsules are involved.

There exists, however, a need for machinery for manipulating smaller batches of capsules, as well as the continuous mass production of capsules. That is, a need exists for much lower cost equipment than conventional capsule filing machinery in order to concurrently separate capsule caps from capsule bodies, fill the capsule bodies, and replace and seal the capsule caps on the filled capsule bodies in volumes on the order of about one hundred capsules at a time. It would be highly desirable to use low cost, manually operated equipment, rather than the expensive, automated, continuously operating equipment that is available for the mass production of capsules.

Some devices do exist for this purpose. For example, Tashi Enterprises located at 5221 Central Avenue, No. 105, Richmond, Calif. 94804, has distributed a capsule loader, model CH 100-00 utilized for orienting the capsule components and separating the capsule caps from the capsule bodies, and a model M 100-00GM capsule filler for sealing the capsule bodies. This equipment is intended to provide advantages over manual separation of capsule caps and bodies and replacing the capsule caps and sealing them to the capsule bodies once the capsules are filled. However, due to its design, this equipment is to some extent unreliable and requires considerable operator skill to prevent the capsules from being damaged during manufacture. Also, it is subject to improper capsule shell component orientation due to the effects of static electrical charges upon the capsule shell components.

SUMMARY OF THE INVENTION

The present invention provides a unique, economical, and easily operable device for orienting, loading, and sealing batches of capsules. The capsule orienting mechanism of the present invention is extremely reliable and easy to operate. Utilizing the orientation mechanism of the invention, capsule shells are quickly and easily aligned in a matrix with all capsules aligned upright in the same vertical orientation with the capsule caps located atop the capsule bodies.

Unlike prior systems, removal of the capsule caps is accomplished with the application of a uniform force each time, and is not subject to variations in forces exerted on the capsule components due to the application of different forces by the same or different operators. Furthermore, once the capsule bodies have been filled, the same mechanism is employed to replace the capsule caps on the bodies and seal the filled capsule shell components together, again without variations in force and without damage to the capsules.

One primary object of the present invention is to provide a capsule filling machine that can be used to manipulate the components of capsule shells for filling and sealing in batches using equipment that is far less expensive than equipment employed in the mass production of capsules.

Another object of the invention is to provide a manually operated capsule orienting, cap removal, and cap sealing mechanism that performs consistently without misalignment of capsule shells or damage to the capsule shells or their component members during filling and sealing of the capsule shells.

A further object of the invention is to provide a capsule shell manipulation device that can be easily operated and which is not susceptible to variations in the forces applied to the capsule components due to differences in manually applied forces by the machine operator.

Hard gelatin capsule shells, sometimes termed dry filled capsules, are formed in two sections. Specifically, hard gelatin capsule shells have a cap with an open mouth and a rounded closed end and a circular, annular cross section that slips over the open mouth of a capsule shell body that is longer than the cap and also has a rounded, closed end. Companies having equipment for manufacturing empty hard gelatin capsule shells include Eli Lilly, Parke-Davis, Schering-Plough, and SmithKline. Hard gelatin capsules are manufactured, for the most part, in eight different sizes which are designed as follows: 000; 00; 0; 1; 2; 3; 4; and 5, listed here in descending order of size.

In one broad aspect the present invention may be considered to be a manually operated apparatus for uniformly orienting a multiplicity of oblong capsule shells of circular cross section, each having a cap fitted telescopically onto a smaller diameter body. The apparatus is comprised of an upper alignment plate, a capsule rectifying plate, a funnel tray, and a capsule receiving tray.

The upper alignment plate forms a capsule orienting tray and defines a matrix of uniformly aligned, oblong capsule receiving cradles each having an oblong horizontal capsule drop slot defined therethrough. Each of the capsule drop slots has a length and width sufficient to permit passage of the capsules therethrough while they are in a horizontal disposition. The capsule rectifying plate is located directly beneath and parallel to the upper alignment plate. The capsule rectifying plate has horizontal capsule rectifying apertures defined therein corresponding to, parallel to, and shaped lengthwise as the capsule drop slots. However, the opposing ends of the capsule rectifying apertures are wider than the capsule bodies and narrower than the capsule caps. The capsule rectifying apertures have midsections that are wider than the capsule caps. The ratio of the length of the midsections to the entire length of the capsule rectifying apertures is between about 0.15 and about 0.20 to one.

The funnel tray is located beneath the capsule rectifying plate. The funnel tray includes funnels located beneath the drop apertures and the rectifying apertures. The funnel tray has circular funnel discharge apertures large enough to provide clearance for the passage of the capsules therethrough while in a vertical orientation. The capsule receiving tray has circular capsule receiving apertures defined therein and located directly beneath the funnel discharge apertures.

A selected one of the upper alignment and capsule rectifying plates is mounted in laterally reciprocal fashion relative to the other of these plates. The reciprocally mounted plate is movable alternatively between a capsule discharge position and a capsule orienting position. In the capsule discharge position the capsule rectifying apertures reside in vertical registration with the capsule drop slots. In the capsule orienting position, the capsule rectifying apertures are at least partly laterally offset from the capsule drop slots.

Preferably, the ratio of the length of the midsections to the entire length of the capsule rectifying apertures is about 0.1836 to one. Where the capsules to be processed are of the size designation 00, each of the midsections is about 0.179 inches in length and the entire length of each of the capsule rectifying apertures is about 0.975 inches in length.

Either the upper alignment plate or the capsule rectifying plate, but not both, are secured permanently in position relative to the funnel tray. In the preferred embodiment of the invention the upper alignment plate is rigidly secured to the funnel tray and the capsule rectifying plate is mounted for reciprocal movement therebetween. Alternatively, the capsule rectifying plate could be rigidly secured to the funnel tray, while the upper alignment plate could be mounted for reciprocal movement above and relative to the capsule rectifying plate.

In embodiments in which the capsule rectifying plate is the movable, reciprocal member, at least one, and preferably a pair of horizontally oriented coil springs are provide to act between the upper alignment plate and the capsule rectifying plate. These horizontal springs bias the capsule rectifying plate toward the capsule orienting position in which the capsule rectifying apertures are at least partially laterally offset from the capsule drop slots.

The capsule receiving apertures in the capsule receiving tray each have a diameter larger than the diameter of the capsule bodies, but smaller than the diameter of the capsule caps. The capsule receiving apertures are arranged in corresponding vertical alignment with the funnels. The capsule receiving tray may also form a portion of a capsule separation assembly. The upper alignment plate, the capsule rectifying plate, and the funnel tray are preferably assembled together as a capsule orientating unit. The capsule orienting unit is removably positionable directly upon the capsule receiving tray.

In another broad aspect the invention may be considered to be a manually operated machine for separating a multiplicity of capsule shells having an oblong shape and capsule caps that fit telescopically onto smaller diameter capsule bodies. The machine is comprised of a capsule receiving tray, a capsule body retention tray, a framework, a capsule cap retention tray, vertical biasing springs, and a lever mechanism.

The capsule receiving tray has circular capsule receiving apertures that are of a diameter large enough to permit passage of the capsule bodies therethrough and smaller in diameter than the capsule caps. The capsule body retention tray is located directly beneath the capsule receiving tray. The capsule body retention tray has capsule body retaining openings with capsule body gripping rings therein that exert less frictional force against movement of the capsule bodies through the capsule body retaining openings in a direction away from the capsule receiving tray than toward the capsule receiving tray.

The framework carries the capsule receiving tray and joins it to the capsule body retention tray in an orientation parallel thereto. The framework is constructed to permit movement of the capsule receiving tray toward the capsule body retention tray.

The capsule cap retention tray is located directly atop the capsule receiving tray and has capsule cap receiving apertures therein. The capsule cap receiving apertures are equipped with capsule cap grasping rings that exert less frictional force against movement of the capsule caps therethrough in a direction away from the capsule receiving tray than in a direction toward the capsule receiving tray.

The vertical biasing springs act between the capsule receiving tray and the capsule body retention tray to urge them apart from each other. The vertical springs urge the capsule receiving tray upwardly and away from the capsule body retention tray. The lever mechanism is joined to the framework and is operable against the force of the vertical biasing springs to entrap the cap retention tray directly atop and in face-to-face contact with the capsule receiving tray. The lever mechanism is also operable to press the capsule cap retention tray and the capsule receiving tray together toward the capsule body retention tray by collapsing the tray support linkage.

The machine of the invention is preferably provided with releaseable latches for holding the framework in a collapsed condition. It is also preferably provided with a capsule sealing plate having a multiplicity of upwardly projecting capsule body engaging posts aligned with the capsule body retaining openings. The framework supports the capsule sealing plate parallel to and beneath the capsule body retention plate. Sealing lever linkages are mounted on the framework and are engageable by the lever mechanism to raise the capsule sealing plate upwardly. This action pushes the capsule bodies upwardly toward the capsule cap retention tray. The lever mechanism has lever arms that are counterrotatable against the sealing lever linkages to raise the capsule sealing plate sufficiently to permanently seal the capsule caps and the capsule bodies together.

Preferably the capsule body gripping rings in the capsule retaining openings are formed as resilient, thin, circular, annular wafers of metal having central cruciform openings defined therein with capsule body retaining flanges between the arms of the cruciform openings. The capsule body retaining flanges are preferably directed at an inclination away from the capsule receiving plate. The capsule cap grasping rings are preferably each formed as a resilient, circular, annular structure.

In still another broad aspect the invention may be considered to be a method of separating a multiplicity of oblong capsule shells wherein the capsule shells include capsule caps frictionally fitted telescopically onto smaller diameter capsule bodies in a separable state, and thereafter permanently attaching the caps to the bodies in a sealed state. The invention is comprised of the steps of dropping the capsule shells in a separable state into a capsule receiving tray, positioning a capsule body retention tray directly beneath the capsule receiving tray, positioning a capsule cap retention tray directly atop the capsule receiving tray, pressing the capsule cap retention tray and the capsule receiving tray together towards the capsule body retention tray, and removing the capsule cap retention tray from the capsule receiving tray.

The capsule receiving tray has a matrix of circular capsule receiving apertures defined therein. These capsule receiving apertures are of a diameter large enough to permit passage of the capsule bodies therethrough and smaller in diameter than the capsule caps. The capsules are dropped into the capsule receiving tray in a manner such that each of the capsules is oriented with its capsule cap located vertically atop its capsule body. Each capsule resides in a separate one of the capsule receiving apertures. The capsule receiving tray laterally immobilizes the capsule bodies and supports the capsule caps from beneath at the capsule receiving apertures.

Each of the capsule bodies is located directly above a separate capsule retaining aperture in the capsule body retention tray. Each capsule retaining aperture contains a capsule body gripping ring. The capsule body gripping rings exert less frictional force against movement of the capsule bodies therethrough in a direction away from the capsule receiving tray than in a direction toward the capsule receiving tray.

The capsule cap retention tray is positioned directly atop the capsule receiving tray. The capsule cap receiving tray has capsule cap receiving apertures therein equipped with capsule cap grasping rings. These grasping rings exert less frictional force against movement of the capsule cap therethrough in a direction away from the capsule receiving tray than in a direction toward the capsule receiving tray. When the capsule retention tray is placed atop of the capsule receiving tray, the capsule caps are advanced into the capsule cap grasping rings, which thereupon engage the capsule caps.

As the capsule cap retention tray and the capsule receiving tray are pressed together toward the capsule body retention tray, the capsule bodies are advanced into the capsule body gripping rings. Therefore, when the capsule cap retention tray is then removed from the capsule receiving tray, the capsule bodies remain lodged in the capsule body gripping rings while the capsule caps remain lodged within the capsule cap grasping rings. Removal of the capsule cap retention tray from the capsule receiving tray thereby concurrently separates the capsule caps from the capsule bodies.

In a preferred implementation of the method of the invention the capsule caps are replaced onto the capsule bodies and sealed thereto once the capsule bodies have been loaded with the desired substance. This is done by replacing the capsule cap retention tray atop the capsule receiving tray and again pressing the capsule cap retention tray and the capsule receiving tray together toward the capsule body retention tray to thereby concurrently replace the capsule caps back on the capsule bodies. Then the capsule bodies are forced upwardly and toward the capsule cap retention tray while concurrently applying an opposing force against the capsule caps. The exertion of this force replaces the capsule caps on the capsule bodies and permanently engages the capsule caps on the capsule bodies. This force is preferably applied by raising a capsule sealing plate having a multiplicity of capsule engaging posts that force the capsule bodies upwardly within the capsule retaining apertures.

The invention may be described with greater clarity and particularity by reference to the accompanying drawings.

DESCRIPTION OF THE EMBODIMENT

Figure 1:
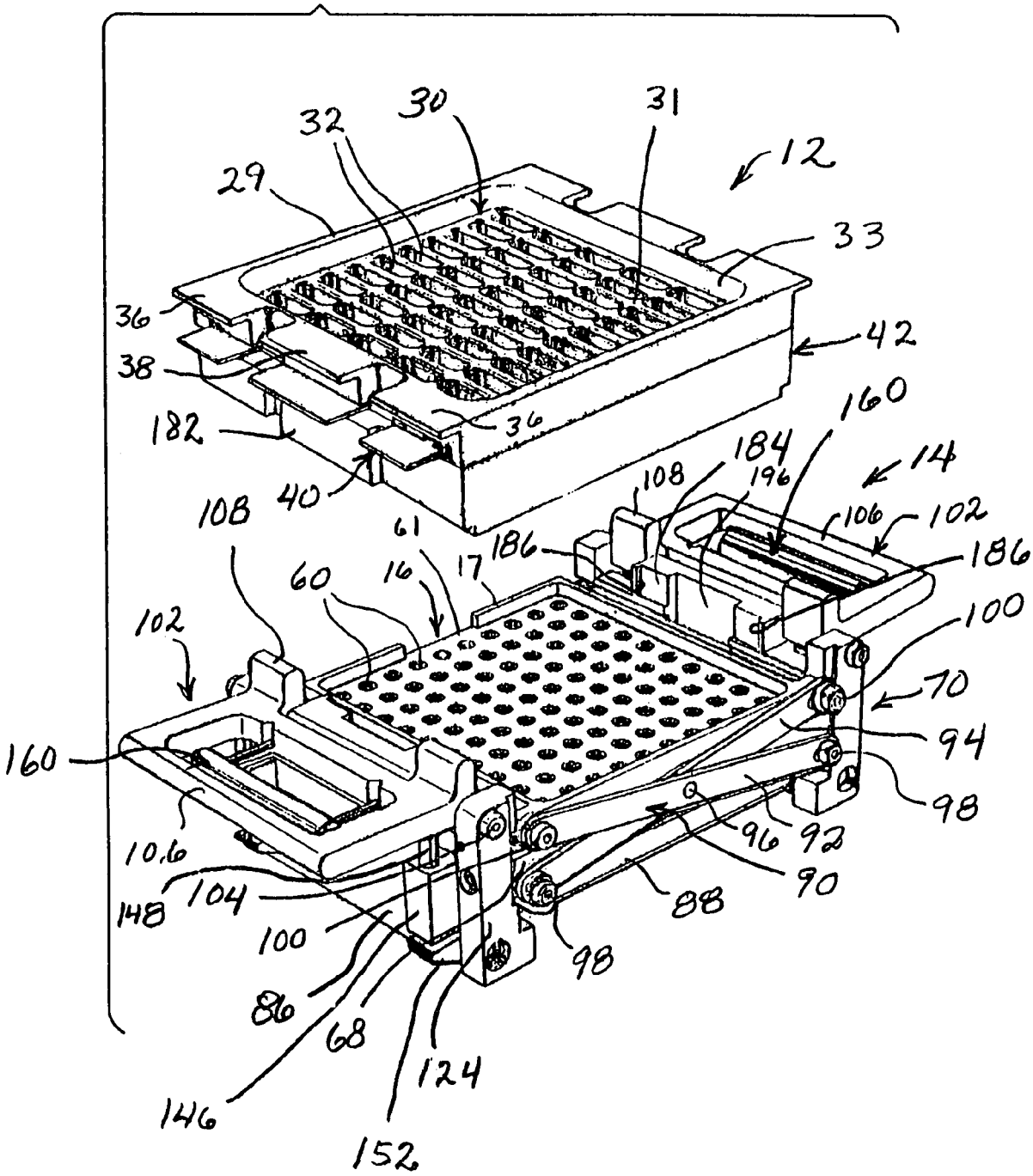
FIG. 1 is an exploded perspective view illustrating a capsule orientating unit positioned above a portion of a capsule separation assembly according to the invention.
Figure 2:
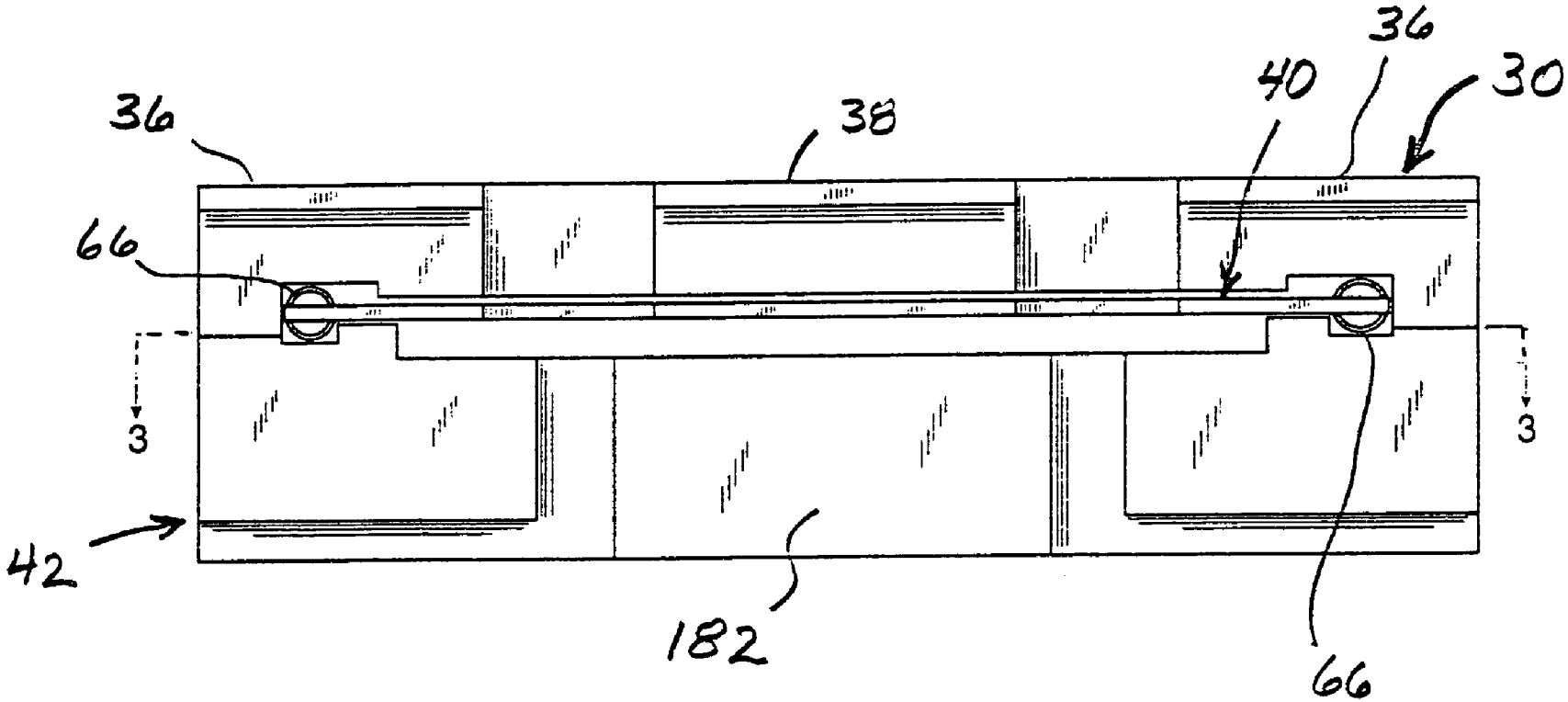
FIG. 2 is a side elevational view of the capsule orienting unit shown in FIG. 1.

FIG. 1 illustrates major components of a preferred embodiment of the manual capsule loading machine according to the invention. As shown in FIG. 1 the capsule loading machine includes a capsule orienting unit indicated generally at 12 and the lower portion of a capsule separation assembly indicated generally at 14. The capsule orienting unit 12 is removably positionable directly upon a capsule receiving tray 16, which forms a part of both an apparatus for uniformly orienting a multiplicity of oblong capsule shells 18 and also the lower portion of the capsule separation assembly 14. The capsule shells 18 are best illustrated in FIGS. 26-30.

Figure 26:
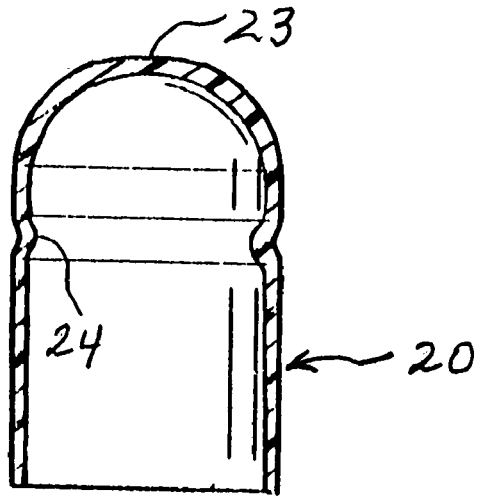
FIG. 26 is an exploded sectional elevational view of a single one of the capsule shells.
Figure 26:
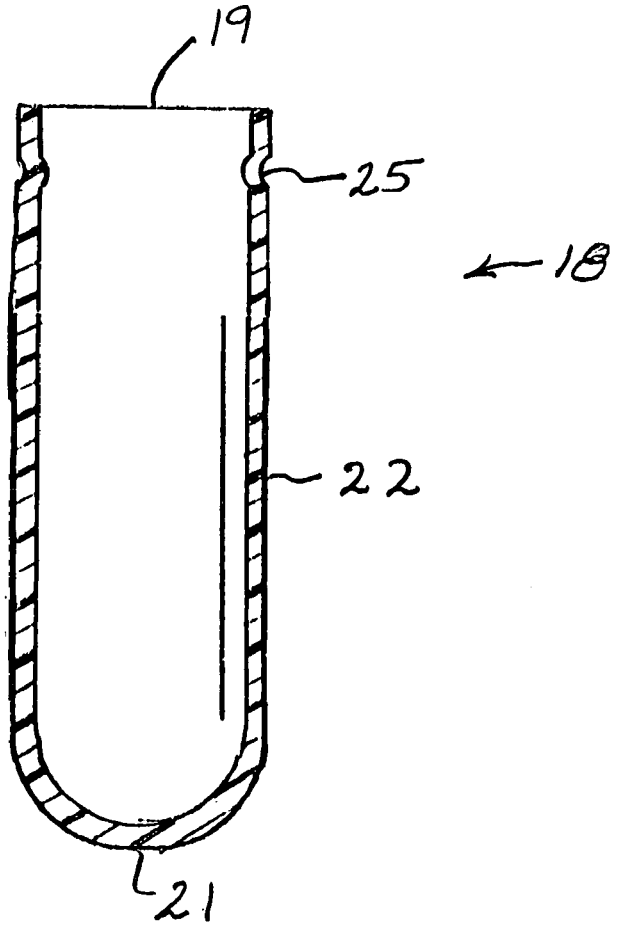

As shown in FIG. 26, for example, each of the capsule shells 18 is an oblong structure of circular cross section. Each capsule shell 18 has a cap 20 that is fitted telescopically onto a smaller diameter body 22.

The capsule shells 18 may be any one of the standard sizes of gelatin capsules ranging from the largest designated "000" to the smallest designated as "5". The capsule orienting unit 12 and the capsule separation assembly must be constructed so as to accommodate capsule shells 18 of a particular one of these sizes. In the embodiment illustrated the manual capsule loading machine shown is designed to concurrently orient, separate, and load capsule shells having the size designation "0".

FIG. 26 is an exploded, sectional, elevational view illustrating a single capsule shell 18 with its cap 20 separated from its body 22. The bottom end 21 of the capsule body 22 is rounded into a hemispherical configuration, while the opposite upper end 19 of the body 22 surrounds an open, circular mouth. The lower end of the capsule cap 20 also surrounds an open circular mouth that fits telescopically about the upper end 19 of the capsule body 22.

As shown in FIG. 26 the cap 20 is slightly deformed proximate its hemispherical top end 23 with an annular, radially inwardly projecting rib 24 that extends about the entire interior perimeter wall of the cap 20. Near its open mouth the capsule body 22 is slightly deformed so that an annular, radially inwardly directed groove or channel 25 is defined in the outer wall surface of the capsule body 22.

The capsule shells 18 are provided for filling with the capsule caps 20 telescopically engaged on the capsule bodies 22, but with a longitudinal separation existing between the radially inwardly projecting rib 24 on the inner wall of the capsule cap 20 and the radially inwardly directed groove 25 in the outer wall of the capsule body 22. Consequently, the capsule cap 20 can be separated from the capsule body 22 by pulling these two capsule components longitudinally apart from each other.

The capsule shells 18 are supplied for filling in a separable state in which the open end 19 of the capsule body 22 resides just short of the lip 24 of the capsule cap 20. When the capsule cap 20 and the capsule body 22 are engaged in their separable state, the cap 20 can be removed from the capsule body 22 by pulling the capsule body 22 and the capsule cap 20 axially apart from each other.

Once the capsule shell 18 has been loaded with the desired substance, the capsule cap 20 is again telescopically engaged upon the capsule body 22 and forced axially toward the rounded lower end 21 thereof until the annular rib 24 in the inner wall of the capsule cap 20 engages the annular groove 25 in the outer wall of the capsule body 22. Once the rib 24 engages the groove 25, the capsule shell 18 is in a sealed condition and the capsule cap 20 an capsule body 22 can no longer be separated from each other due to the interengagement of the rib 24 in the groove 25. The capsule shell 18 is thereupon permanently sealed.

The capsule orienting unit 12 and its component parts are illustrated in FIGS. 1-9. The capsule orienting unit 12 is comprised of an upper alignment plate 30 defining a matrix of uniformly aligned capsule-receiving cradles 32, each having an oblong, horizontal capsule drop slot 34 defined therethrough. Each of the capsule drop slots 34 has a length and width just sufficient to permit passage of the capsule shells 18 in their telescopically engaged separable states, and while in a horizontal disposition.

The capsule receiving tray 16 forms a part of the capsule separation assembly, although it is not part of the capsule orienting unit 12. Rather, the upper alignment plate 30, the capsule rectifying plate 40, and the funnel tray 42 are assembled together to form the capsule orienting unit 12. The capsule orienting unit 12 is removably positionable directly atop the capsule receiving tray 16, as illustrated in FIG. 1.

The upper alignment plate 30 forms a shallow tray having a floor 31 surrounded by an inclined retaining wall 33. The upper alignment plate 30 forms a capsule orienting tray that defines a rectilinear matrix of oblong, horizontal capsule drop slots 34 at the bottoms of the cradles 32. The capsule drop slots 34 have the same shape as a capsule shell 18 and are just slightly larger than a capsule shell 18 when the capsule shells 18 are in their separable condition. In the embodiment of the invention illustrated, there are fifty different capsule-receiving cradles 32 defined in the floor 31 of the upper alignment plate 30. The capsule-receiving cradles 32 are arranged in a five by ten matrix array and are all aligned in a common direction, as illustration in FIGS. 5 and 6.

The peripheral, horizontal rim 29 of the upper alignment plate 30 resides at a distance of 0.75 inches above the level of the floor 31. The containment walls 33 of the upper alignment plate 30 are inclined at an angle of forty-five degrees and the corners of the tray formed by the upper alignment plate 30 are rounded, not square.

The individual capsule drop slots 34 are radiused all around. The floor 31 is 0.300 inches in thickness. The thickness of the floor 31 is such that the depth of the capsule drop slots is sufficient to discourage disoriented capsules from "jumping out" of the capsule retaining cradles 32.

The length of each of the capsule drop slots 34 is tightly controlled and just greater than the length of the capsule shells 18 when they are in a separable condition. It is therefore possible to perform a visual inspection of the capsule shells 18 residing in the matrix of horizontal capsule drop slots 34 prior to discharging the capsule shells 18 through the capsule rectifying apertures 44. A visual inspection of the capsules is useful, since some capsules arrive in a sealed condition, rather than in a separable condition. If the capsules are in a sealed condition, the gap between one or both ends of the capsule and the extremities of the capsule drop slot 34 in which such a capsule resides will be noticeable. Consequently, such prematurely sealed capsules can be removed and replaced with capsules which are in the separable condition prior to moving the capsule rectifying plate 40. Also, some of the capsules arrive with caps on both ends of the capsule bodies. With a visual inspection the cap on the closed, rounded end of the capsule body can be removed.

Each of the oblong, horizontal capsule drop slots 34 defined in the floor 31 of the capsule alignment plate 30 has a length and width just sufficiently large enough to permit passage of the capsule shells 18 therethrough while in a horizontal disposition and in a separable state. The upper alignment plate 30 is provided with corner flanges 36 and center flanges 38 on its opposite sides extending away from each other in a direction perpendicular to the orientation of the capsule drop slots 34.

Figure 3:
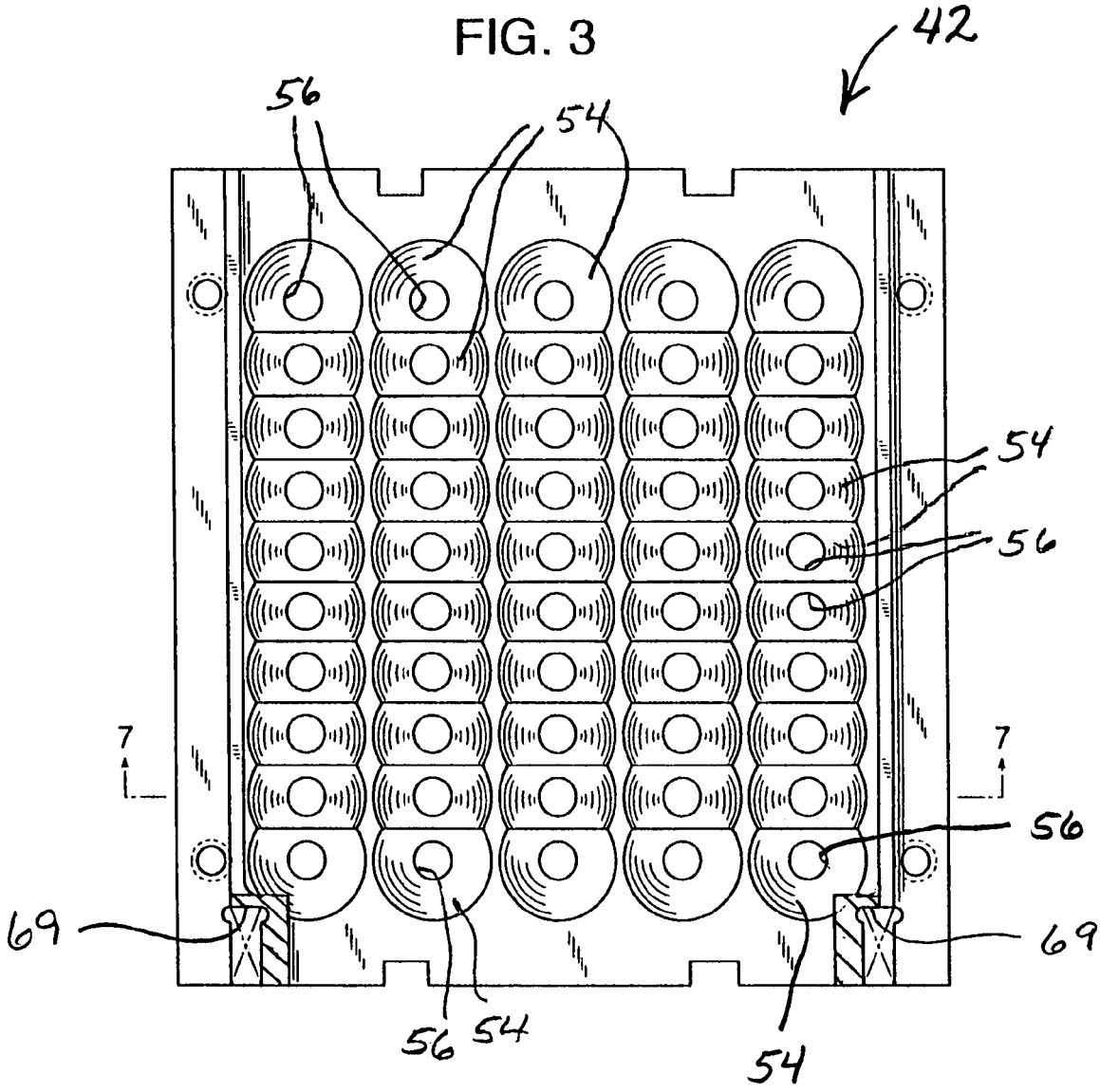
FIG. 3 is a sectional detail taken along the lines 3-3 in FIG. 2 showing a top plan view of the funnel tray of the capsule orienting unit of FIG. 2.
Figure 4:
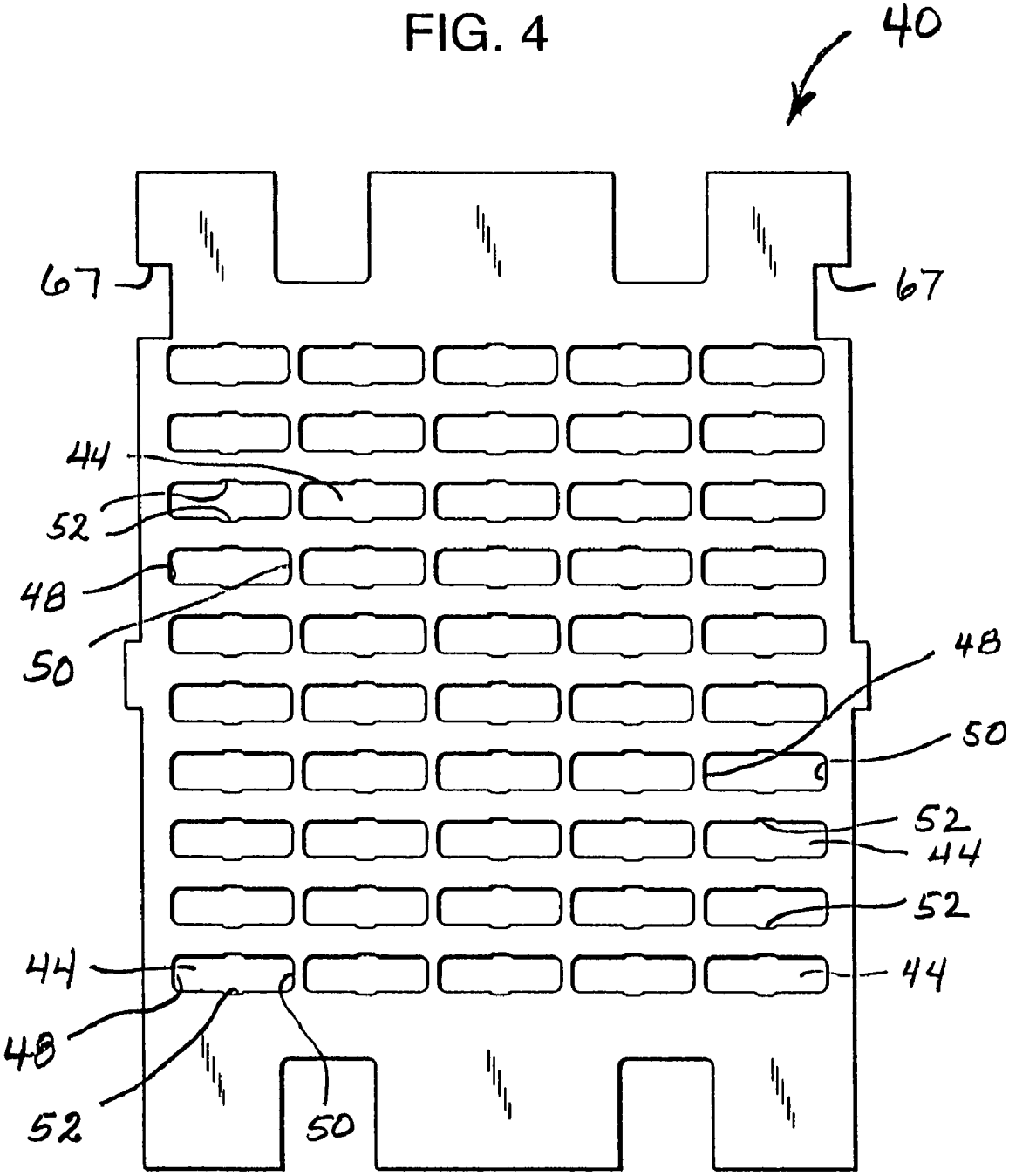
FIG. 4 is a top plan view of the capsule rectifying plate employed in the capsule orienting unit of FIG. 2, shown in isolation.
Figure 7:
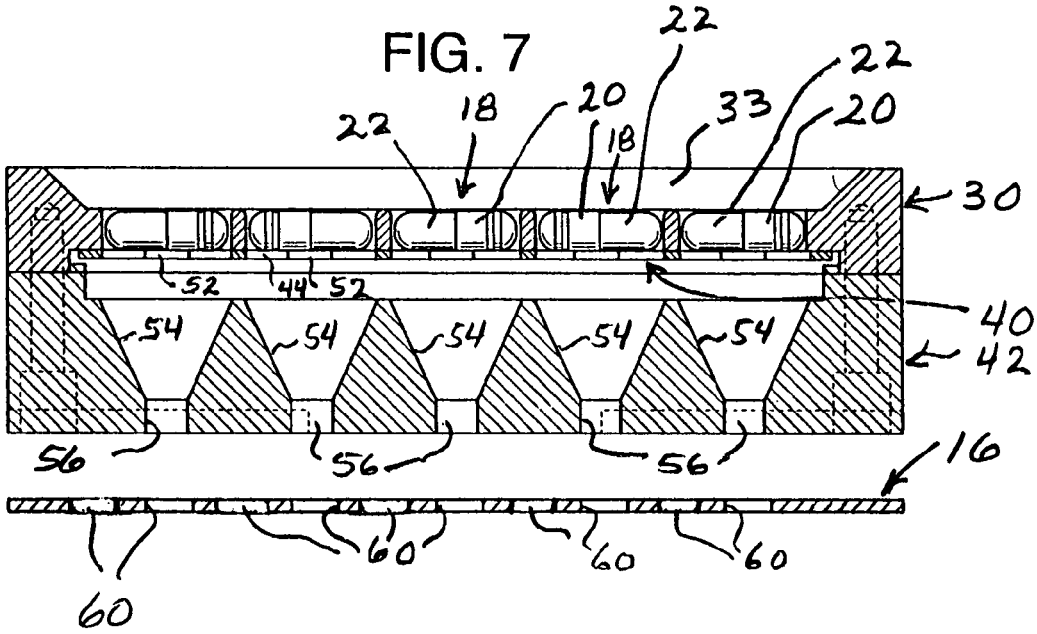
FIG. 7 is a sectional elevational view of the capsule orienting apparatus of the invention, taken along the lines 7-7 in FIG. 5, shown with capsules loaded on the upper alignment plate and with the capsule rectifying plate in the capsule orienting position.
Figure 8:
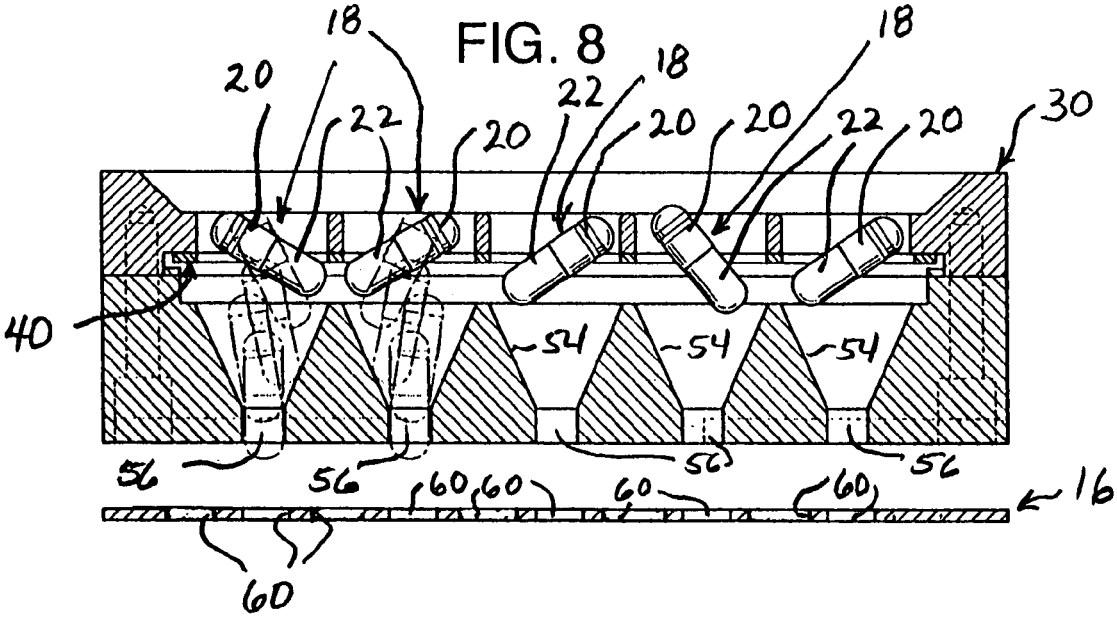
FIG. 8 illustrates the apparatus of FIG. 7 as the capsule rectifying plate is moved to the capsule discharge position.
Figure 9:
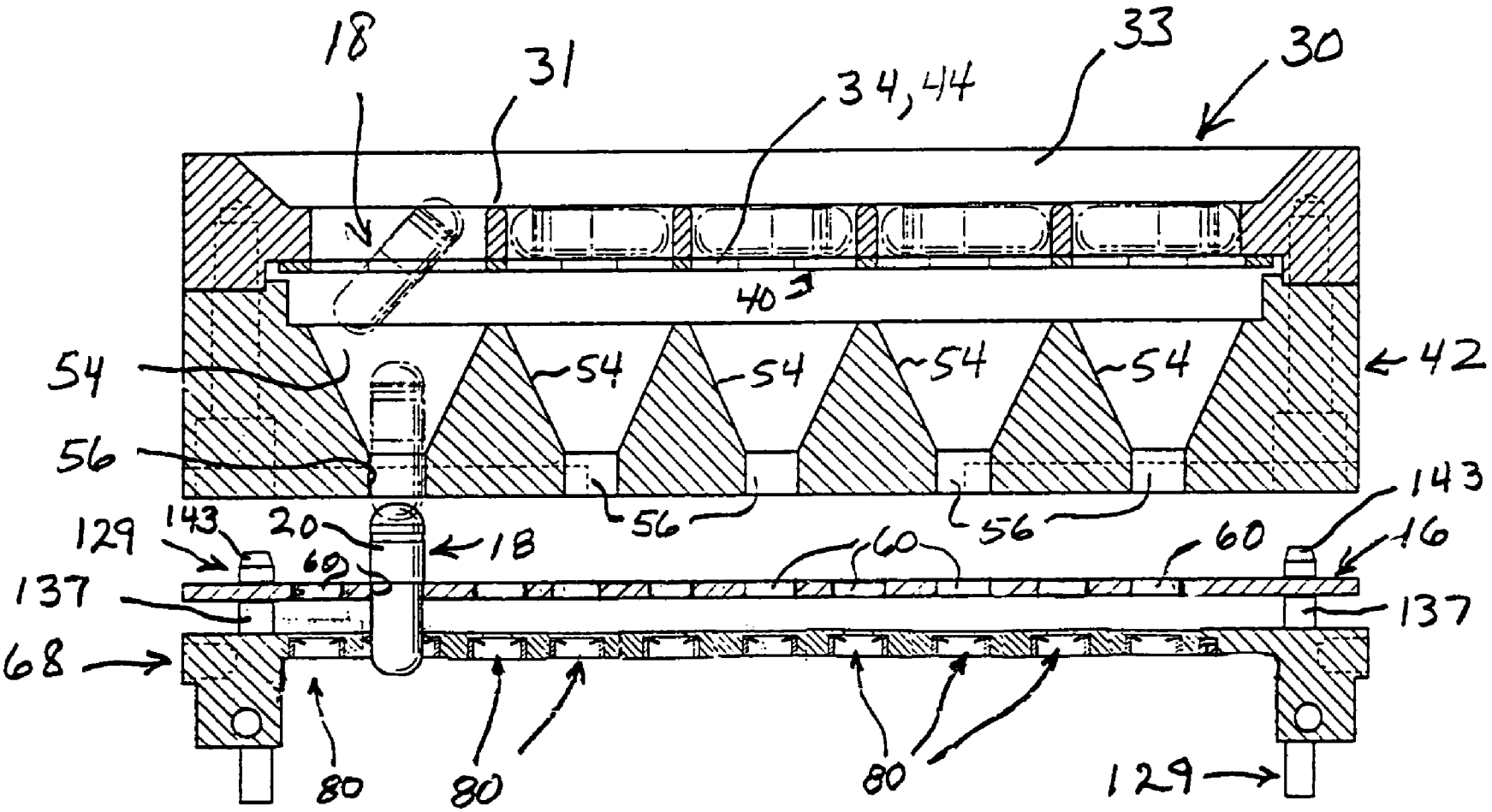
FIG. 9 illustrates the manner of descent of the capsules through the funnel plate and into the capsule receiving tray.

The capsule orienting unit 12 is further comprised of a capsule rectifying plate 40, shown in isolation in FIG. 4, and a funnel tray 42 shown in a top plan view in FIG. 3, and also visible in FIGS. 7, 8, and 9. The capsule rectifying plate 40 is located directly beneath and parallel to the upper alignment plate 30 and has horizontal capsule rectifying apertures 44 defined therein. The capsule rectifying apertures 44 correspond to, are parallel to, and are shaped lengthwise the same as the capsule drop slots 34.

The capsule rectifying apertures 44 have opposing ends 48 and 50 that are wider than the capsule bodies 22 and narrower than the capsule caps 20. The capsule rectifying apertures 44 also each have a midsection 52 that is wider than the capsule caps 20. The ratio of the length of the midsections 52 to the entire length of the capsule rectifying apertures 44, as measured longitudinally between the opposing ends 48 and 50 thereof, is between 0.15 and about 0.20 to one in the embodiment of the invention illustrated.

Figure 25:
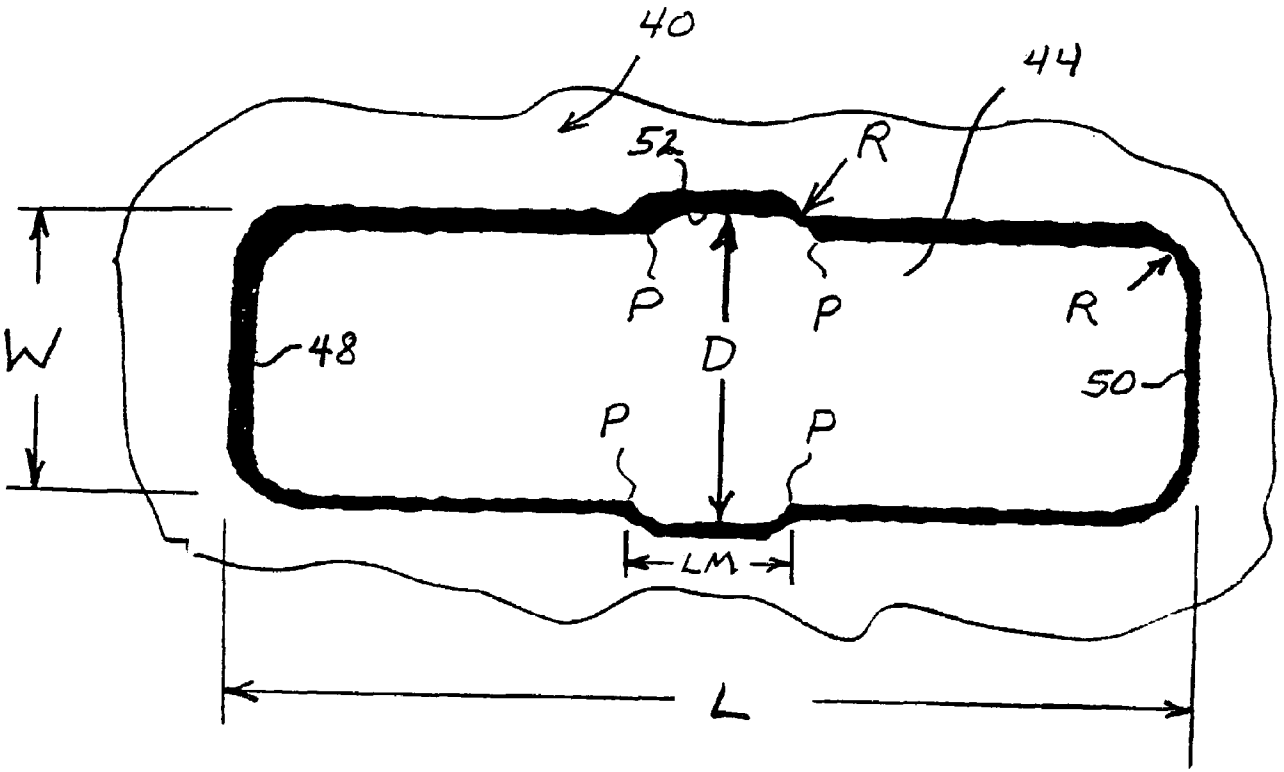
FIG. 25 is a plan detail illustrating a single one of the capsule rectifying apertures in the capsule rectifying plate of FIG. 4.

The relative dimensions of the capsule rectifying apertures 44 are critical to the capsule rectifying function of the invention and must be closely matched to the particular size capsule utilized. FIG. 25 is an enlarged, detail view of a small area of the capsule rectifying plate 40 showing a single one of the capsule rectifying apertures 44.

Each capsule rectifying aperture 44 formed in the capsule rectifying plate 40 is dimensioned for use in rectifying the orientation of "0" size capsules. Specifically, each of the capsule rectifying apertures 44 has an overall length indicated at L equal to 0.975 inches and an overall width W equal to 0.288 inches ±0.001 inches at the opposing ends 48 and 50. The midsection 52 of each capsule rectifying aperture 44 must be between about fifteen percent and twenty percent of the overall length L of the capsule rectifying aperture 44.

In the embodiment illustrated each of the midsections 52 has a length LM that is about 0.1836 of the overall length L of the capsule rectifying aperture 44. The length LM is preferably 0.179 inches in length, measured between the points P where the radii of curvature R of the midsections 52 intersect the longitudinal linear sides of the ends 48 and 50. The distance between the edges of the capsule rectifying apertures 44 measured at the midsections 52 thereof is indicated as a distance D in FIG. 25. In the embodiment of the invention illustrated the distance D is equal to 0.318 inches ±0.001 inches. The transitions between the midsections 52 and the ends 48 and 50 of the capsule rectifying apertures 44 have a radius of curvature R equal to 0.093 inches. The radius of curvature of the corners of each capsule rectifying aperture 44 at the ends 48 and 50 thereof is likewise a radius of curvature R equal to 0.093 inches.

The pivot points P indicated in FIG. 25 must be close to the center of gravity of the capsule shell 18, which is within the capsule body 22 but quite near the intersection of the capsule cap 20 with the capsule body 22 when the capsule shell 18 is in the separable condition. The determining factor for the minimum length LM of the midsections 52 of the capsule rectifying apertures 44 is determined by the diameter of the capsule cap 20 itself.

The funnel tray 42 is illustrated in FIG. 3 and is located directly beneath the capsule rectifying plate 40. The funnel tray 42 defines a total of fifty funnels 54 located beneath the drop slots 34 of the upper alignment plate 30 and beneath the rectifying apertures 44 of the capsule rectifying plate 40 when the capsule rectifying plate 40 is moved so that the capsule rectifying apertures 44 are aligned directly beneath the capsule drop slots 34. The funnels 54 have circular discharge openings 56 that are large enough to provide clearance for passage of the "0" size capsule shells 18 therethrough while in a vertical orientation. The capsule receiving tray 16, visible in FIG. 1 and shown in plan view in FIG. 19, has circular capsule receiving apertures 60 defined therethrough directly beneath the funnel discharge openings 56, as best illustrated in FIGS. 7 and 8.

Figure 5:
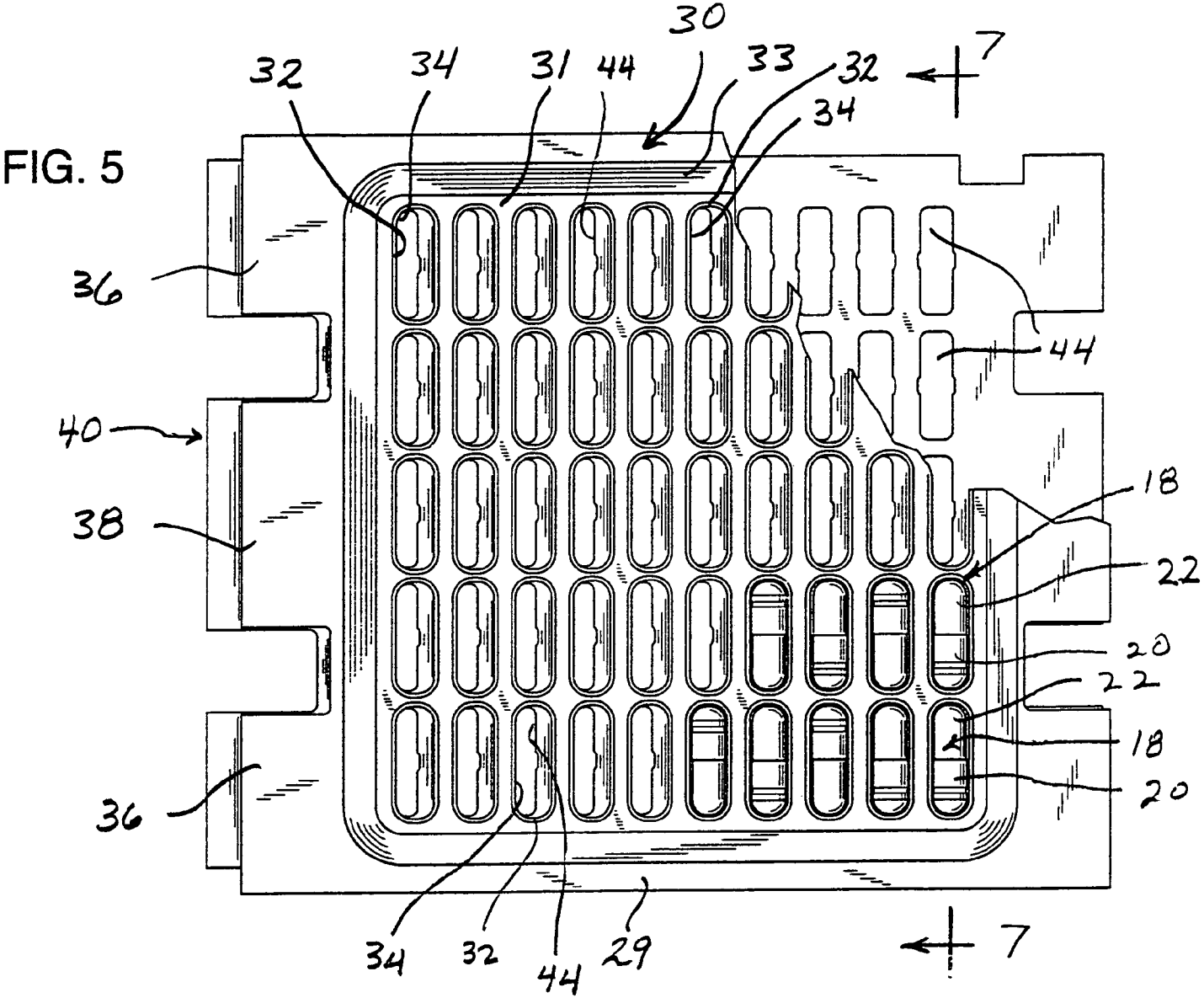
FIG. 5 is a top plan view of the capsule orienting unit of FIG. 2 with the capsule rectifying plate shown in the capsule orienting position.

Either the upper alignment plate 30 or the capsule rectifying plate 40 must be mounted in a laterally reciprocal fashion relative to the other of these plates. Preferably, the upper alignment plate 30 is rigidly secured to the funnel tray 42 and the capsule rectifying plate 40 is mounted for reciprocal movement therebetween. At least one, and preferably a pair, of horizontally oriented springs 66 are provided to bias the capsule rectifying plate 40 to a position in which the capsule rectifying apertures 44 are offset from vertical alignment with the capsule drop slots 34. This condition is illustrated in FIG. 5. The springs 66 are a pair of horizontally disposed, mutually parallel coil springs, the outboard ends of which are visible in FIG. 2. The outboard ends of the coil springs 66 bear against the bearing ledges 67 of the capsule rectifying plate 40. The bearing ledges 67 are visible in FIG. 4.

The inboard ends of the horizontal springs 66 bear partially against the pocket walls 69 formed in the funnel plate 42, visible in FIG. 3, and partially against a corresponding pocket wall formed in the underside of the upper alignment plate 30. The springs 66 bias the capsule rectifying plate 40 to the left, as viewed in FIG. 5, which illustrates the capsule orienting position of the capsule rectifying plate 40 in which the capsule rectifying apertures 44 are at least partially laterally offset from the capsule drop slots 34. If a lateral force 71 is applied against the edge of the capsule rectifying plate 40, as illustrated by the directional arrow in FIG. 6, the capsule rectifying plate 40 is movable in a laterally reciprocal fashion relative to the upper alignment plate 30 to the capsule discharge position illustrated in solid lines in FIG. 6. In this position the capsule rectifying apertures 44 reside in vertical registration with the capsule drop slots 34. Once the capsule shells 18 drop down to the capsule rectifying plate 16, in a manner hereinafter described, a release of the manual force 71 allows the springs 66 to return the capsule rectifying plate 40 to the normal, offset capsule orienting position illustrated in FIG. 5 and in phantom in FIG. 6.

The operation of the capsule orienting unit 12 is best described with reference to FIGS. 5-9. A quantity of capsule shells 18 in the separable condition are poured from a supply onto the upper alignment plate 30 with the capsule rectifying plate 40 biased by the springs 66 to the capsule-orienting position illustrated in FIG. 5. The capsule-orienting unit 12 may be manually shaken slightly with a lateral reciprocating movement until a separate capsule shell 18 resides nested in each capsule receiving cradle 32 and within each drop slot 34, resting atop a portion of the capsule rectifying plate 40 located therebeneath. FIG. 5 illustrates capsule shells 18 occupying only the capsule drop slots 32 in the lower, left-hand corner of the upper alignment plate 30 so as to allow observation of the offset alignment of the capsule rectifying plate 40 therebeneath. However, it is to be understood that, in the normal use of the invention, there will be a total of fifty capsule shells 18 disposed in the fifty capsule drop slots 34, one in each drop slot. Any excess capsule shells 18 that were not shaken into the capsule drop slots 34 are removed from atop the upper alignment plate 30.

It should be noted in FIG. 5 that, when the capsule shells 18 rest in position in the capsule drop slots 34, some of the capsule caps 20 will be oriented in one direction, while other of the capsule caps 20 will be oriented in the opposite direction. However, all of the capsule shells 18 are uniformly aligned within their respective capsule drop slots 34, even though the capsule caps 20 of some of the capsule shells 18 are at opposite ends of the capsule drop slots 34 from each other.

Figure 6:
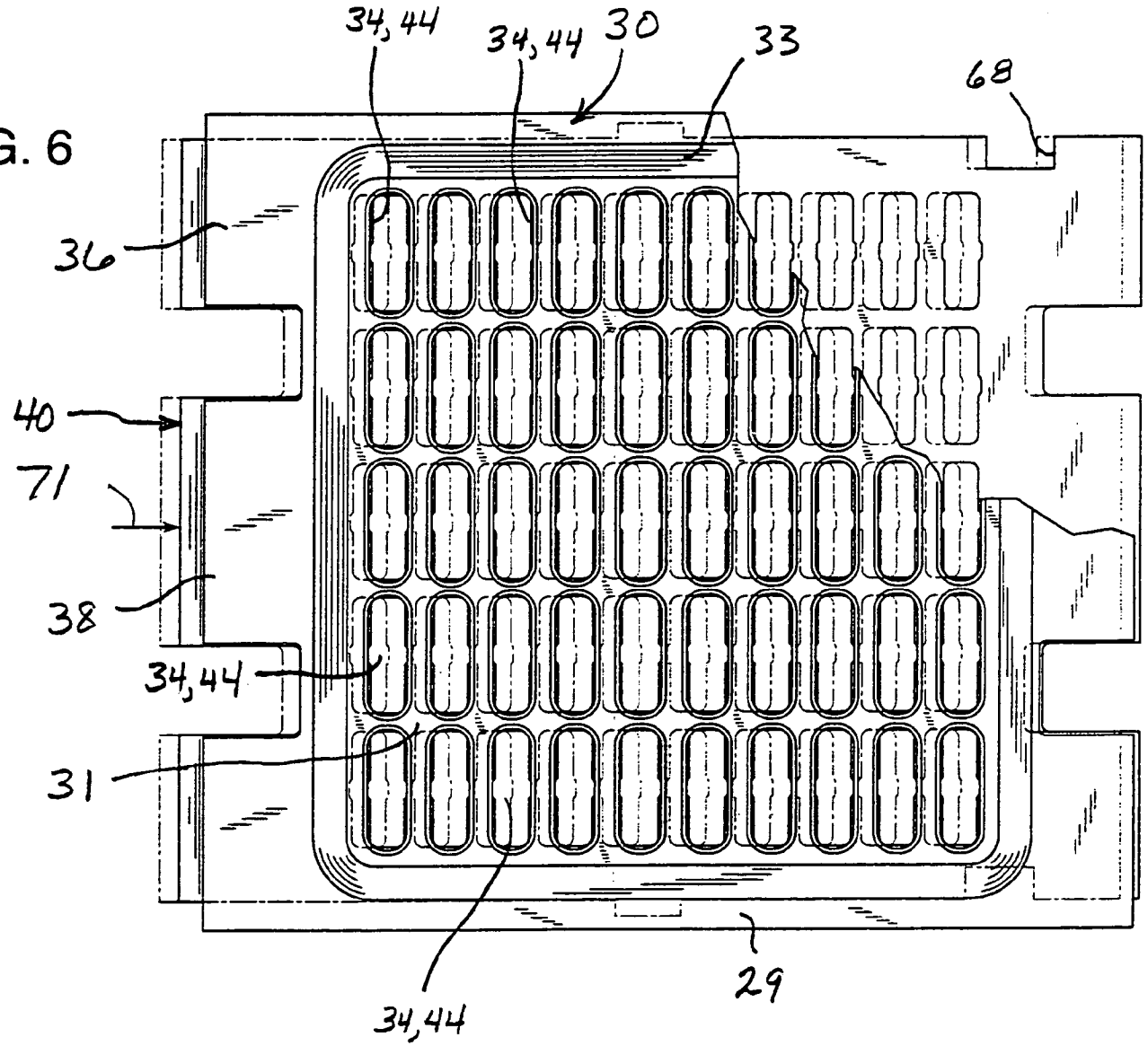
FIG. 6 is a top plan view of the capsule orienting unit of FIG. 2 with the capsule rectifying plate shown in the capsule discharge position.

Once any excess capsule shells 18 that have not lodged in a capsule drop slot 34 have been removed from the upper alignment plate 30, a force 71 is manually applied to laterally shift the capsule rectifying plate 40 relative to both the upper alignment plate 30 and the funnel tray 42. The application of this lateral force 71 is illustrated in FIG. 6. As shown in that drawing figure, when the capsule rectifying plate 40 is shifted in this manner against the bias of the springs 66, the capsule rectifying apertures 44 are all concurrently aligned directly beneath the capsule drop slots 34.

FIG. 7 is a sectional elevational view taken along the lines 7-7 of FIG. 5 and illustrates the capsule shells 18 all residing in a horizontal disposition within their respective drop slots 34 with the capsule rectifying plate 40 in the normal capsule orienting position illustrated in FIG. 5. Once the capsule rectifying plate 40 has been shifted by the manual application of the force 71, however, the capsule shells 18 are no longer supported by the underlying capsule rectifying plate 40. The capsule shells 18 then drop downwardly as illustrated in FIG. 8.

Because of the length LM of the midsections 52 relative to the overall length L of each capsule rectifying aperture 44, as shown in FIG. 25, the lower end 21 of the capsule body 22 will always tilt downwardly before the upper end 23 of the capsule cap 20, irrespective of which end the capsule cap 20 occupies in the capsule drop slot 34. This is shown in FIG. 8.

The present invention represents a significant improvement over prior systems that have attempted to achieve consistent, uniform, concurrent upright orientation of a multiplicity of capsules so that the capsule caps 20 are all located atop the capsule bodies 22. For example, the Model CH100-00 Capsule Loader previously described employs a system in which a proportionate length of the capsule rectifying aperture midsections relative to the overall length of the capsule rectifying aperture is considerably greater than the proportionate length LM to the overall length L indicated in FIG. 25 of the present invention. Consequently, not infrequently the alignment of the capsule rectifying apertures with the capsule drop slots of that device results simply in a migration of the capsule shell to one end of the capsule rectifying aperture 44. That is, instead of dropping, the capsule shell 18 merely slides toward one end of the capsule rectifying aperture 44 and simply hangs there.

Alternatively, in that prior art system the discharge of a capsule shell 18 sometimes results in the capsule making a one hundred eighty degree "forward flip", landing crosswise on the funnel below. When this occurs any capsule misaligned in its funnel must be forceably dislodged. Such malfunctions are aggravated by electrostatic charges on the capsule shells.

Due to the high surface area to mass ratio, the behavior of a gelatin capsule shall is adversely affected by the presence of static electricity that inevitably accumulates during handling. The presence of such static electricity was confirmed experimentally using an antistatic spray.

In order to obviate, or at least minimize, the undesirable effect of static electricity, no nonconducting materials are used in the capsule orienting unit 12. In addition, a substantial metal mass aids in voltage distribution.

It is significant that, while there are a total of one hundred capsule receiving apertures 60 formed in the capsule receiving tray 16, there are only fifty capsule drop slots 32 in the upper alignment plate 30, only fifty capsule rectifying apertures 44 in the capsule rectifying plate 40, and only fifty funnels 54 in the funnel tray 42. The reason for this is that the capsule shells 18 occupy a considerably greater horizontal area when residing in the horizontal disposition in which they are introduced into the capsule orienting mechanism 12 than they do when dropped into the capsule receiving apertures 60 in the capsule receiving tray 16. As a consequence, in order to fully load the capsule receiving tray 16, it is necessary to fill the upper alignment plate 30 with capsule shells 18 twice and discharge them in two consecutive capsule drop operations.

The slots 184 in the framework end plate 86 are wider than the positioning lugs 182 on the ends of the funnel tray 42. The slots 184 are bounded at their opposite ends by vertical abutment ledges 186, as illustrated in FIG. 1. The difference between the width of the positioning lugs 182 and the distance between the vertical abutment ledges 186 in the framework end plates 86 is equal to the horizontal distance between the center line of each two adjacent capsule receiving apertures 60. That is, the distance between the vertical abutment ledges 186 on each framework end plate 70 is equal to the spacing indicated at S in FIG. 19. Therefore, each time the upper alignment plate 30 is filled with capsule shells 18, the capsule alignment mechanism 12 is shifted laterally so that the positioning lugs 182 alternatively reside in contact with the vertical abutment ledge 186 closest to the scissors linkage 90, or, the vertical abutment ledge 186 furthest from the scissors linkage 90 with each successful capsule orienting and drop operation.

With capsule shells 18 in their separable state or condition in each of the capsule drop slots 34, the capsule rectifying plate 40 is shifted relative to the upper alignment plate 30 and the funnel tray 42 by application of a force 71. Initially the capsule orienting device 12 is moved as close to the scissors linkage 90 as the abutment ledges 186 closest to the scissors linkage 90 will permit. Capsules are thereupon dropped into alternative horizontal rows, as viewed in FIG. 19, commencing with the lowermost row. Fifty capsules are discharged from the capsule orienting unit 12 in this first operation.

The capsule orienting unit 12 is then shifted laterally in a direction away from the scissors linkage 90 as far as the vertical abutment ledges 186 furthest therefrom will permit. All of the fifty capsule drop slots 34 are again filled with capsule shells 18 in their separable states. The capsule rectifying plate 40 is then again shifted to the right by the application of a force 71, as viewed in FIG. 6. The fifty capsules then in the upper alignment plate 30 will thereupon drop vertically downwardly through the funnel openings 56 and into each of the capsule receiving apertures 60 in every other horizontal row, as viewed in FIG. 19, commencing with the second row from the bottom, as viewed in that drawing figure. It can be seen, therefore, that, with two sequential operations of the capsule orienting unit 12 atop the capsule receiving tray 16, all of the capsule receiving apertures 60 will be filled with capsule shells 18 in their separable state.

When the capsule rectifying plate 40 is pushed inwardly as illustrated in FIG. 6 by a force 71, the capsule shells 18 will drop from their horizontal orientation illustrated in FIG. 7 into their respective funnels 54, as illustrated in FIG. 8. As shown in FIG. 8, with the relative dimensions of the capsule rectifying apertures 44 as illustrated in FIG. 25, and as described herein, the lower end 21 of the capsule body 22 will always drop first, irrespective of the end of the capsule drop slot 34 at which the capsule cap 20 is located. Consequently, all of the capsule shells 18 will drop into their respective funnels 54 into a vertical orientation as illustrated in phantom in FIG. 8. The capsule cap 20 will always be on top and the capsule body 22 will always be directed downwardly beneath the cap 20.

The funnel discharge openings 56 are just slightly larger than the diameters of the capsule caps 20 so that the capsule shells 18 are in a vertical orientation with the capsule caps 20 on top and the capsule body 22 beneath when the capsule shells 18 reach the bottoms of the funnels 54. The capsule shells 18 drop through the funnel discharge openings 56 and directly into the capsule receiving apertures 60 in the capsule receiving tray 16. The capsule receiving apertures 60 are each of a diameter just slightly larger than the diameter of the capsule bodies 22 and slightly smaller than the diameter of the capsule caps 20. The capsule receiving apertures 60 are arranged in corresponding vertical alignment with the discharge openings 56 of the funnels 54.

To summarize, the manually operated apparatus for uniformly orienting a multiplicity of oblong capsule shells 18 of circular cross section may be briefly described as follows. Each of the capsule shells 18 has a cap 20 fitted telescopically onto a small diameter body 22, but with the upper edge 19 of the capsule body 22 still located a short distance from the radially inwardly directed rib 24. The capsule shells 18 are in a separable state or condition prior to being filled.

The capsule tipping or rectifying plate 40 is located beneath the upper alignment plate 30 and has tipping or rectifying apertures 44 therein shaped as the capsule shells 18, but having opposing ends 48 and 50 that are wider than the capsule bodies 22 and narrower than the capsule caps 20. The mid sections 52 of the tipping or rectifying apertures 44 are widened. That is, their transverse dimension D is slightly greater than the diameter of the capsule caps 20. The length LM of the midsections 52, relative to the entire length L of the capsule rectifying apertures 44, is between about fifteen percent and twenty percent of the total length of the tipping or rectifying apertures 44. The measure of the length of the midsection 52 to the entire length of the capsule rectifying apertures 44 between the opposing ends 48 and 50 thereof is between 0.15 and about 0.20 to one. The midsections 52 of the tipping apertures 44 preferably have a length of between about seventeen percent of the total length of the tipping apertures 44.

A funnel tray 42 is located beneath the capsule rectifying plate 40 and includes a rectilinear matrix of funnels 54 located beneath the drop apertures 34. The funnels 54 are provided for receiving the capsule shells 18 from the capsule tipping or rectifying plate 40. The funnels 54 have circular discharge openings 56 large enough to provide clearance for passage of the capsule shells 18 therethrough while in a vertical orientation.

The funnel tray 42 and the upper alignment plate 30 are rigidly joined to each other and a capsule rectifying or tipping plate 40 is mounted between the upper alignment plate 30 and the funnel tray 42. The capsule tipping or rectifying plate 40 is movable in laterally reciprocal fashion relative to the alignment plate 30 and the funnel tray 42, as indicated by the force 71 in FIG. 6.

As shown in FIGS. 5 and 6, the tipping or rectifying apertures 44 are alternatively aligned and misaligned with the capsule drop slots 34. Alignment unit springs 66, visible in FIG. 2, bias the tipping plate 40 to a condition in which the tipping apertures 44 are misaligned with the drop apertures 34.

The capsule receiving apertures 60 in the capsule receiving tray 16 are each of diameter larger than the diameter of the capsule bodies 22 and smaller than the diameter of the capsule caps 20. The capsule receiving apertures 60 are arranged in corresponding vertical alignment with the funnels 54. The upper alignment plate 30, the capsule rectifying or tipping plate 40, and the funnel tray 42 are assembled together as a capsule orienting unit 12. The capsule orienting unit 12 is removably positionable upon the capsule receiving tray 16.

Figure 10:
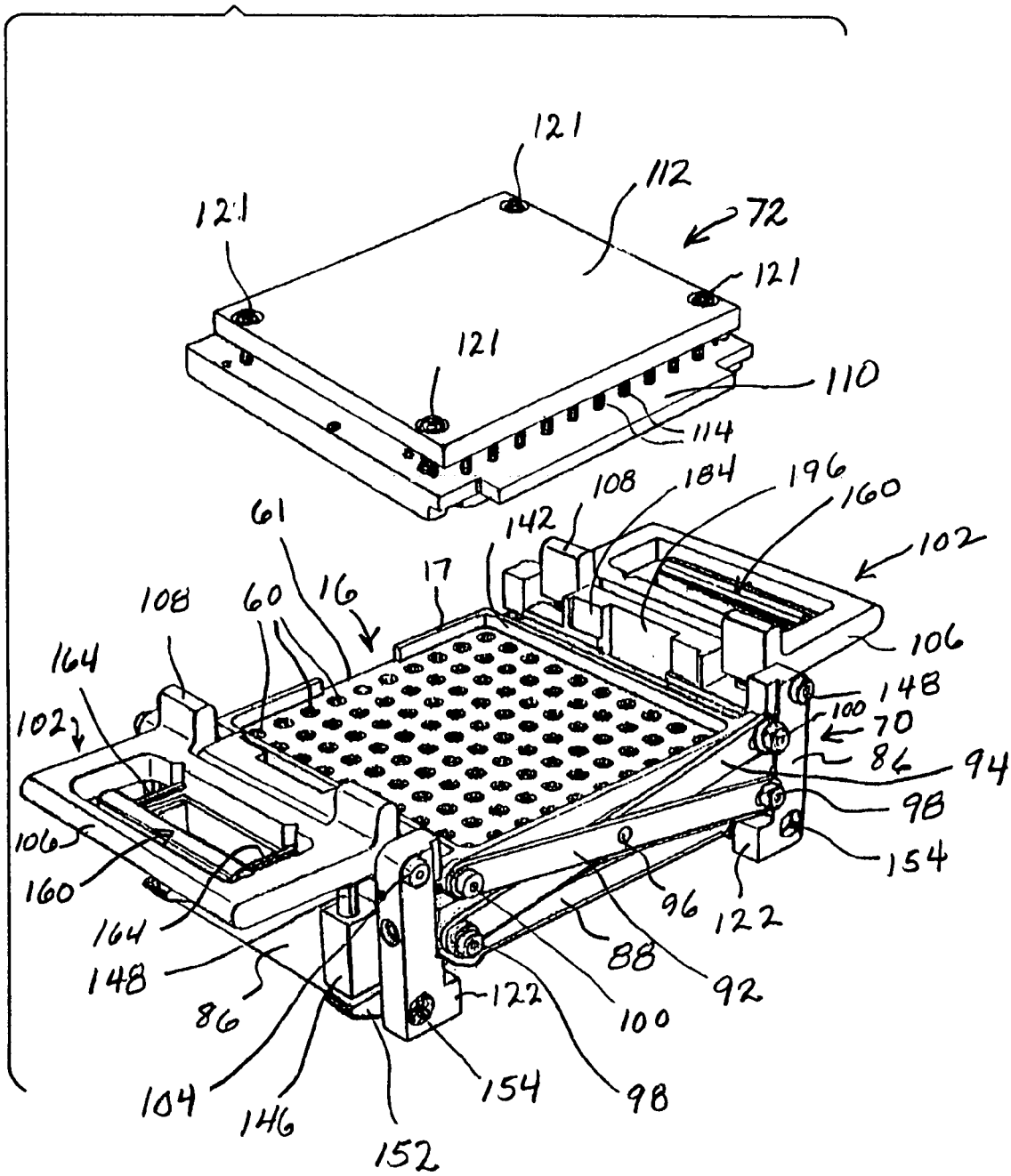
FIG. 10 is an exploded perspective view of the capsule separation assembly of the invention showing the capsule top lift assembly thereof removed from atop the capsule receiving tray.
Figure 11:
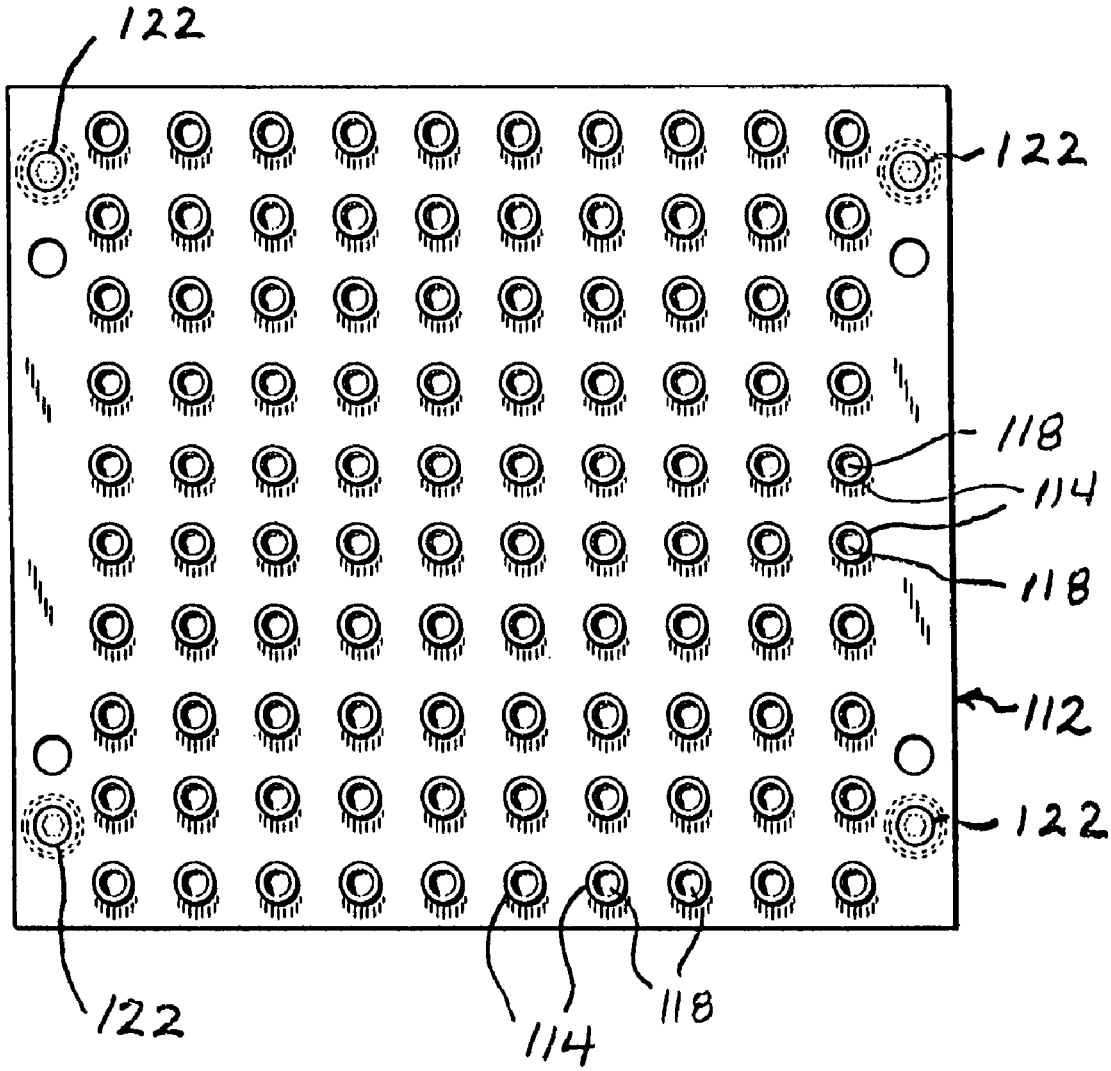
FIG. 11 is a bottom plan view of the capsule cap sealing plate of the capsule top lift assembly of the invention, shown in isolation.
Figure 16:
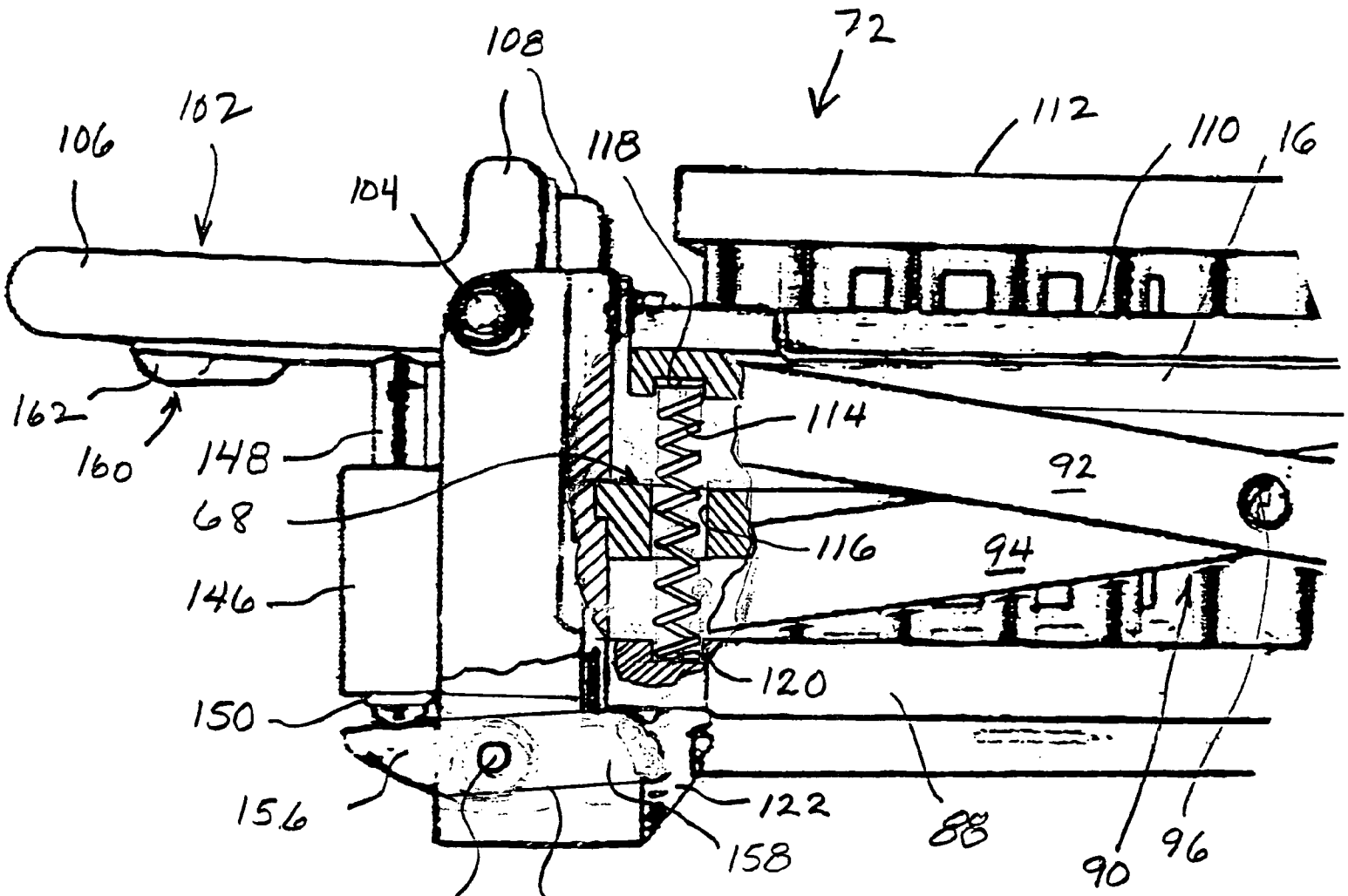
FIG. 16 is an elevational detail of one end of the capsule separation assembly, partially broken away.

The capsule separation assembly is comprised of the capsule receiving tray 16, a capsule body retention tray 68, partially visible in FIGS. 1 and 16, a framework 70 that maintains the capsule body retention tray 68 and the capsule receiving tray 16 parallel to each other in a static condition, and a capsule top lift assembly 72, illustrated in FIG. 10.

The capsule body retention tray 68 is located beneath the capsule receiving tray 16 and has capsule body retaining openings 74 with capsule body gripping rings 76 therein, as illustrated in the detail views of FIGS. 27-30. Capsule alignment apertures 75 are defined concentrically within the capsule body retaining openings 74 at the upper surface 81 of the capsule body retention tray 68 and are of a diameter just slightly larger than the outer diameter of the capsule body 22.

Figure 17:
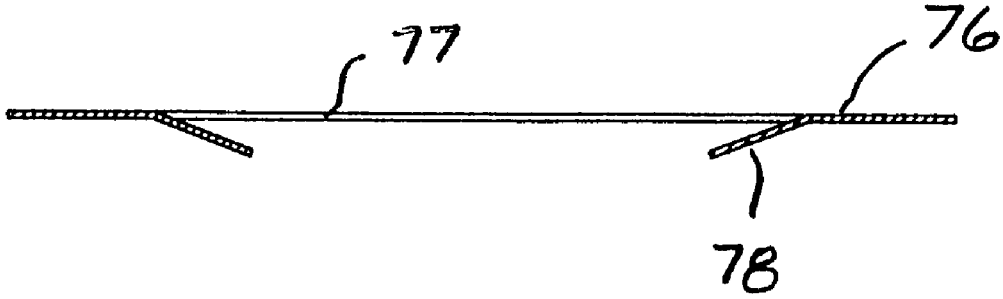
FIG. 17 is a sectional elevational view of a single one of the capsule body gripping 10, rings, shown in isolation.
Figure 18:
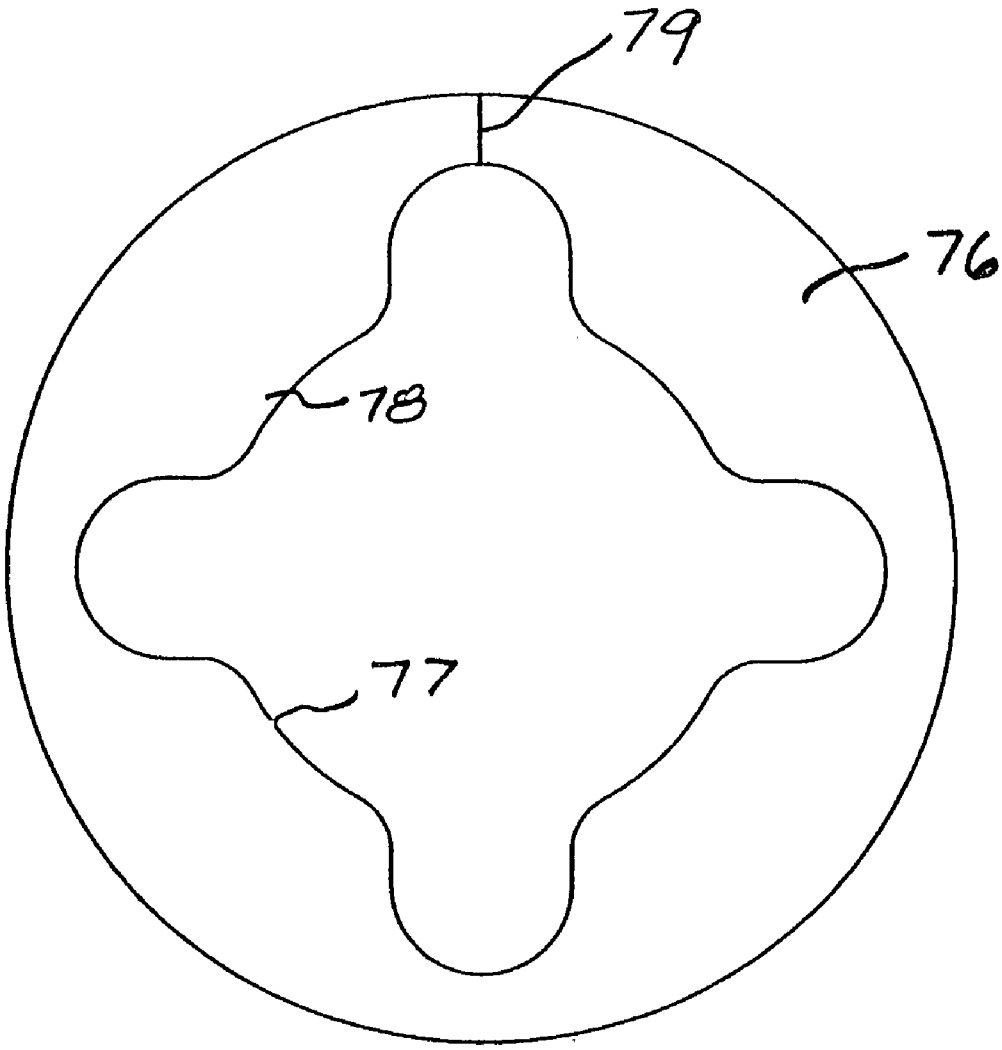
FIG. 18 is a top plan view of a single one of the capsule body gripping rings.

A single one of the capsule body gripping rings 76 is illustrated in isolation in a sectional elevational detail in FIG. 17, and in a plan detail in FIG. 18. Each of the capsule body gripping rings 76 is formed of a thin, circular, annular, stainless steel wafer and has a circular outer perimeter with a central opening therein of a generally cruciform shape with rounded ends, as illustrated in FIG. 18. Each of the capsule body gripping rings 76 is formed with deflectable gripping tabs or flanges 78 defined between the four rounded ends of the central cruciform opening 77. The capsule body gripping rings 76 are split at a radial demarcation 79.

The capsule body gripping rings 76 are mounted in the capsule body retaining openings 74 and are held in position by cylindrical, annular retaining rings 80 that are friction fitted into the capsule body retaining opening 74 beneath the capsule body retaining rings 76. The retaining rings 80 support the peripheral margins of the capsule body gripping rings 76 from beneath, but leave a narrow gap within the capsule body retaining openings 74 to allow a certain amount of "play" in an axial direction at the peripheral margins of the capsule body gripping rings 76. That is, the distance from the upper edges of the retaining rings 80 to the undersurfaces 82 of the annular web of material of the capsule body retention tray 68 surrounding the capsule alignment apertures 75 is slightly greater than the thickness of the capsule body gripping rings 76.

The framework 70 of the capsule separation assembly 14 includes a pair of opposing, vertical upright framework end plates 86 which are anchored to and rigidly support the capsule body retention tray 68 in a horizontal disposition at an intermediate location beneath the capsule receiving tray 16 and above a horizontally oriented capsule sealing plate 88.

The funnel tray 42 is provided with a pair of positioning lugs 182 at its opposing ends. The positioning lugs 182 are received in corresponding slots 184 formed in the inner face of the framework end plates 86.

Figure 15:
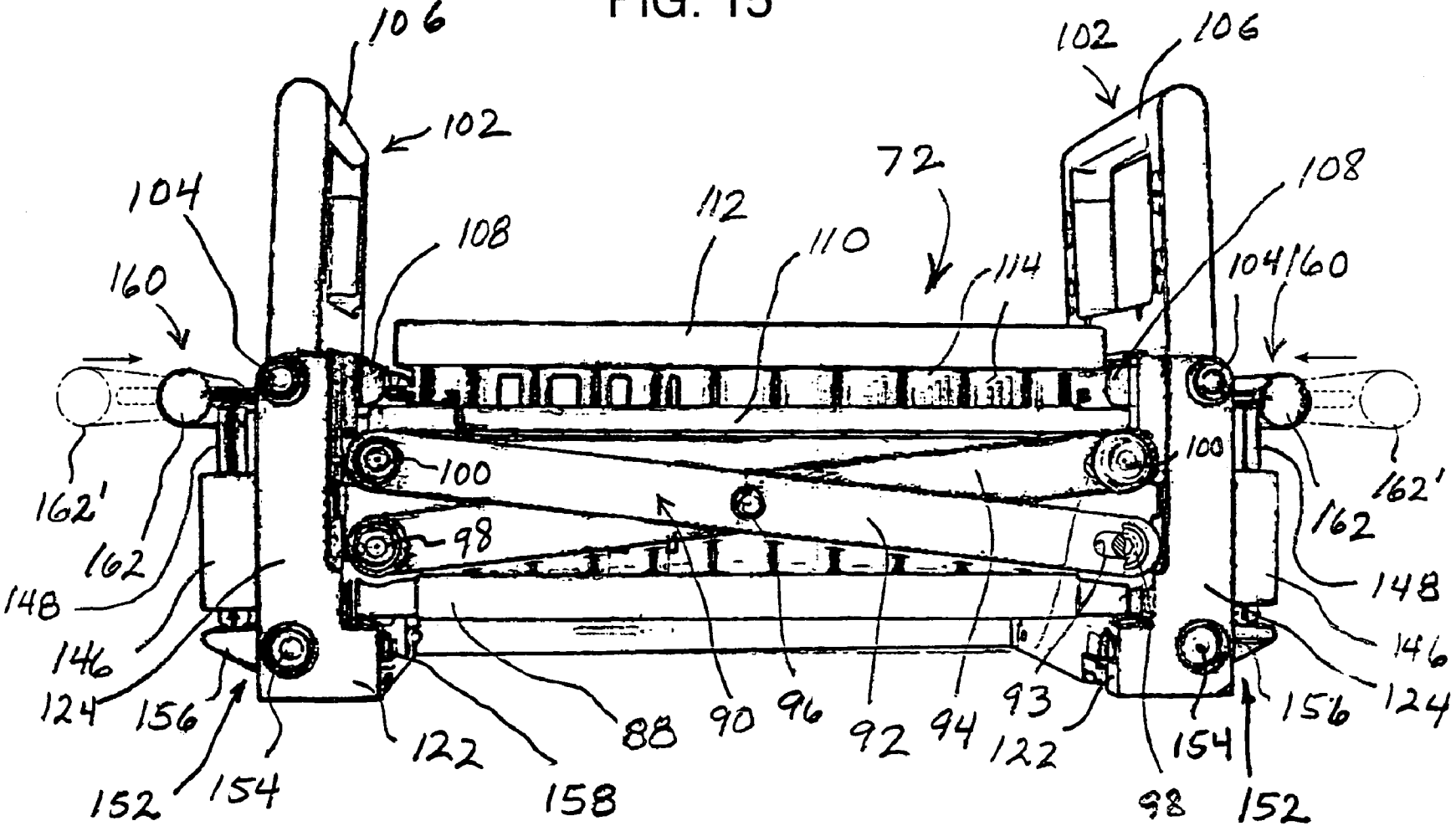
FIG. 15 is a front perspective view of the capsule separation assembly illustrating the capsule top lift assembly being forced toward the capsule body retention tray.
Figure 22:
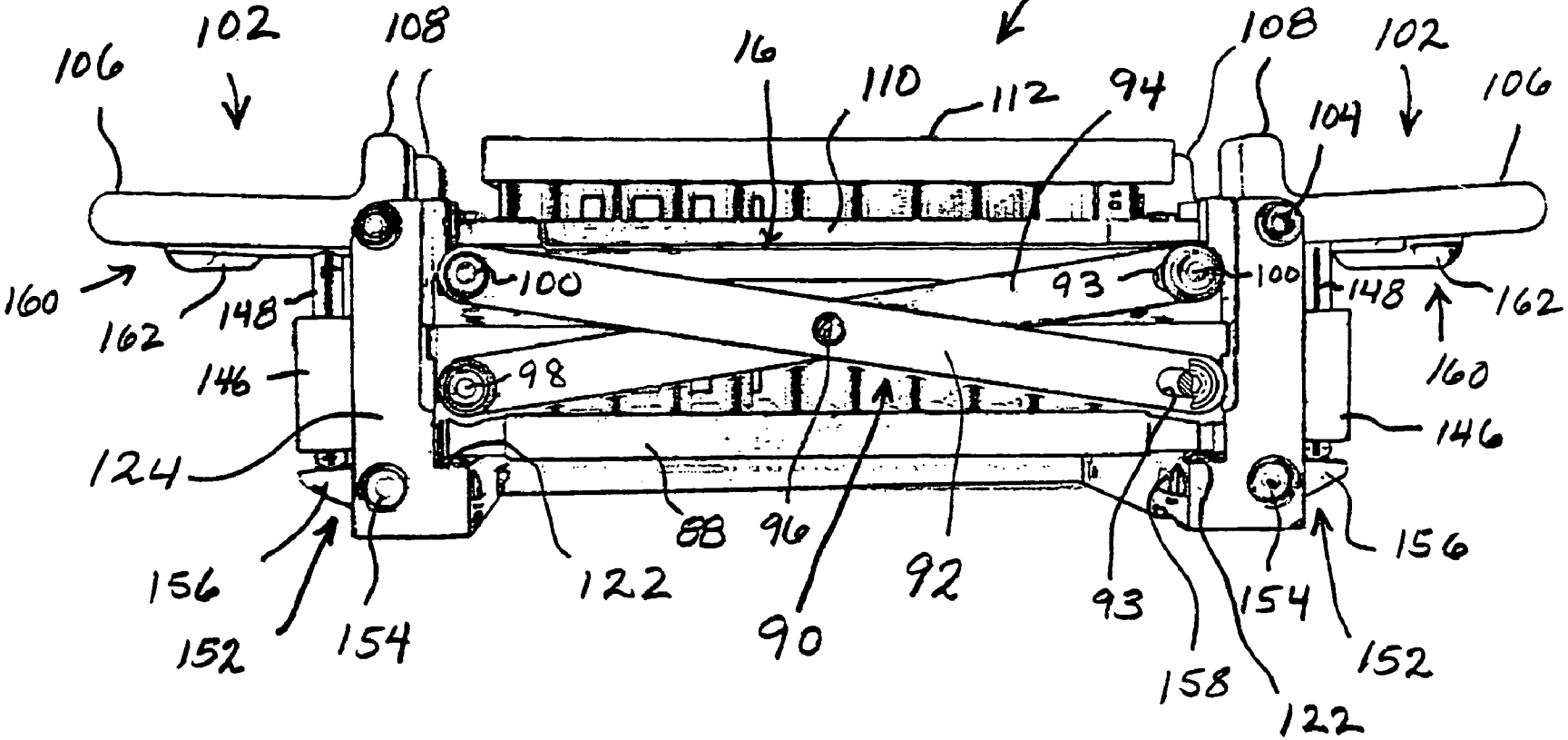
FIG. 22 is a front perspective view showing the capsule separation assembly in the condition depicted in FIG. 13.
Figure 23:
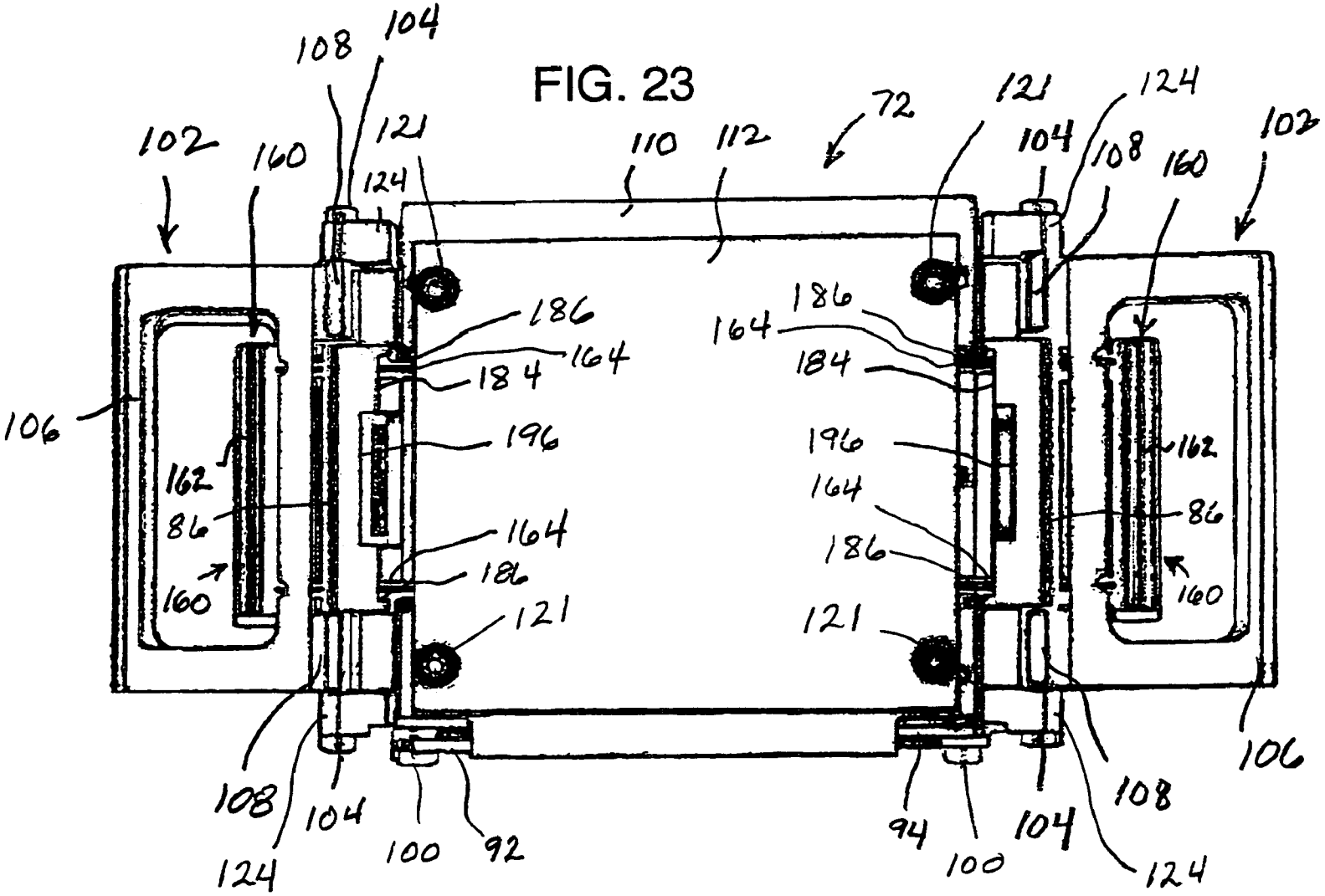
FIG. 23 is a top plan view of the capsule separation assembly of FIG. 13, but with the latching pins engaged.
Figure 24:
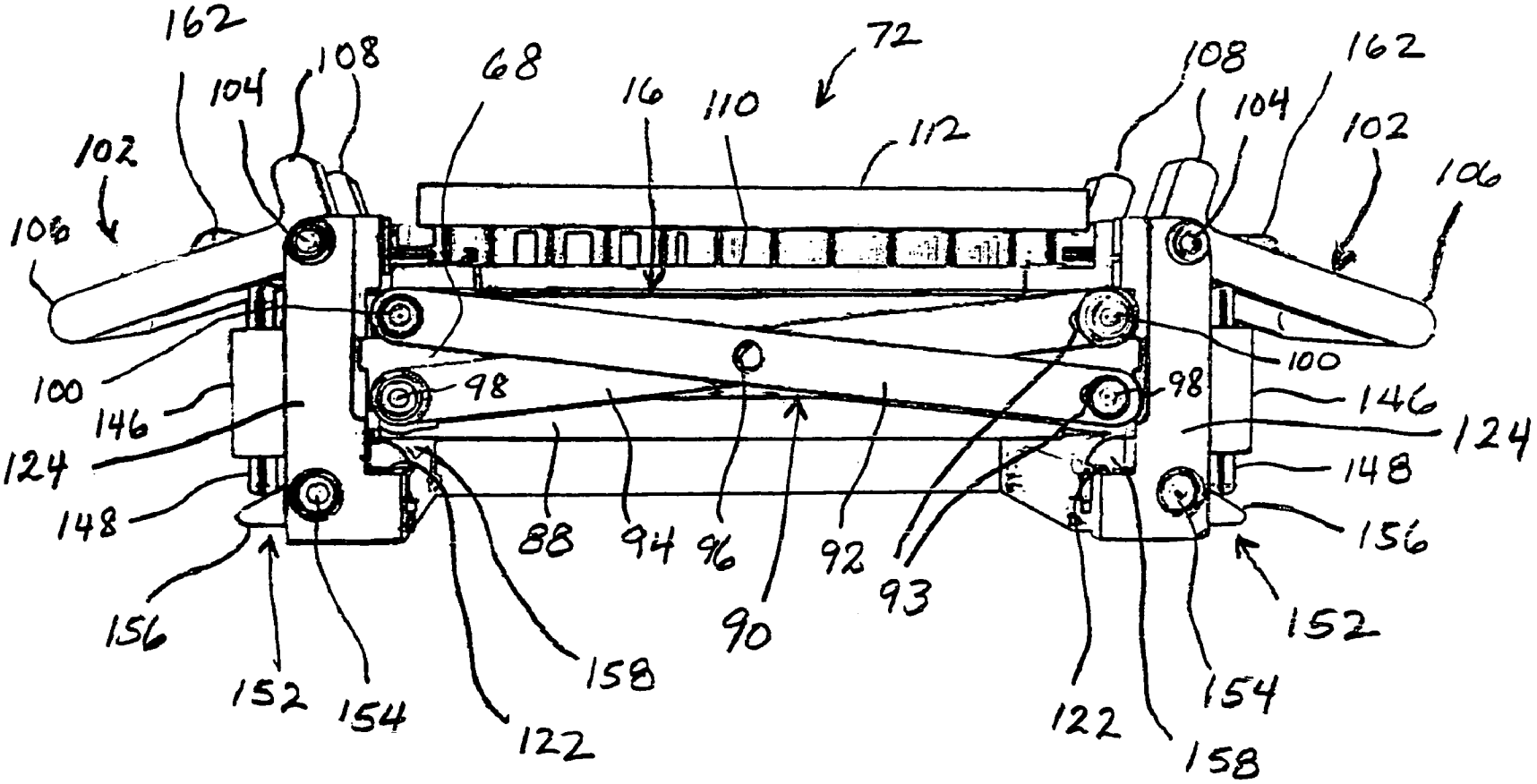
FIG. 24 is a front perspective view illustrating counter-rotation of the levers and raising of the capsule sealing plate of the invention.

A scissors linkage 90 is used to support the capsule receiving tray 16 at a variable distance above the stationary capsule body retention tray 68. The scissors linkage 90 includes a pair of linear, intersecting bars 92 and 94. The bars 92 and 94 are pivotally connected to each other at their centers by a pivot connection 96. The lower extremities of the scissors linkage bars 92 and 94 are pivotally connected to the opposing ends of the capsule body retention tray 68 by means of rotatable couplings 98. Similarly, the upper extremities of both of the scissors linkage bars 92 and 94 are coupled to opposing ends of the capsule receiving tray 16 by pivotal connections 100. The pivot connections 98, 100 at the right-hand end of the scissors linkage 90 are sliding connections. That is, the pivot pins 98, 100 at the right-hand end of the scissors linkage 90 are securely attached to the capsule receiving tray 16 and the capsule body retention tray 68 respectively. These pivot connections pass through elongated eyes 93 at the right-hand ends of the scissors linkage bars 92 and 94 so that the scissors linkage 90 is able to collapse. The elongated sliding coupling eyes are shown in FIGS. 15, 22, and 24.

A pair of bellcrank levers 102 are joined to the opposing ends of the framework end plates 86 by pivot connections 104. The bellcrank levers 102 are mounted on the framework 70 and are rotatable about horizontal axes at their pivot connections 104. The bellcrank levers 102 have U-shaped handgrips 106 and a pair of opposing feet 108 oriented perpendicular to the U-shaped handgrips 106.

In addition to the lower portion 14, the capsule separation assembly also includes a capsule top lift assembly 72. The capsule top lift assembly 72 is illustrated in section in the exploded view of FIG. 12. Specifically, the capsule top lift assembly 72 is comprised of a capsule cap retention tray 110 and a capsule top pressure plate 112. The capsule top pressure plate 112 is located above the capsule cap retention tray 110.

The capsule top pressure plate 112 is a rectangular plate having a smooth upper surface and is provided with a multiplicity of depending cap pressure posts 114 oriented in a matrix and located concentrically above and in alignment with capsule cap receiving openings 114 in the capsule cap retention tray 110. The ends of the depending extremities of the capsule cap pressure posts 114 are rounded in a concave manner to form positioning seats 118 the positioning seats 118 are curved to conform to the convex surface curvature of the upper ends 23 of the capsule caps 20.

At its four corners the top pressure plate 112 is provided with countersunken bolt apertures 120 designed to receive the heads of bolts 121. The distal extremities 123 of the shanks of the bolts 121 are externally threaded to engage internally tapped bolt openings 126 at the four corners of the capsule cap retention tray 110. A vertically oriented, compressible coil spring 128 is disposed coaxially about the shanks of each of the bolts 121. The vertically oriented springs 128 serve to bias the top pressure plate 112 away from the capsule cap retention tray 110.

The capsule cap receiving tray 110 has capsule cap receiving holes 130 defined therein at the position of each capsule shell 18. The capsule receiving holes 130 are stepped in diameter and have a relatively large aperture 132 at the top surface of the capsule cap receiving tray 110, and a relatively small, concentrically located capsule cap guide opening 134 at the bottom surface of the capsule cap receiving tray 110. Radially outwardly directed channels are formed in the structure of the capsule cap receiving tray 110 at each of the capsule cap receiving holes 130 therein at the demarcations between the capsule cap receiving apertures openings 132 and the capsule cap guide openings 134. Radial channels are defined in the wall structure of the capsule cap receiving tray 110 at each of the capsule cap receiving holes 130 therein. Each radial channel receives a resilient, rubber, capsule cap grasping ring 136.

Each of the capsule cap grasping rings 136 has a central, frustoconically-shaped aperture 138 defined therethrough. Each aperture 138 has a narrower diameter opening facing the relatively large diameter aperture 132 and a larger diameter opening equal to the diameter of the capsule cap guide opening 134. The grasping rings 136 thereby exert less frictional force against movement of the capsule caps 20 therethrough in a direction away from the capsule receiving tray 16, than in a direction toward the capsule receiving tray 16. The capsule cap grasping rings 136 permit passage of the capsule caps 20 therethrough and provide greater resistance to movement of the capsule caps 20 therethrough in a direction toward the capsule receiving tray 16 than away from the capsule receiving tray 16.

Figure 12:
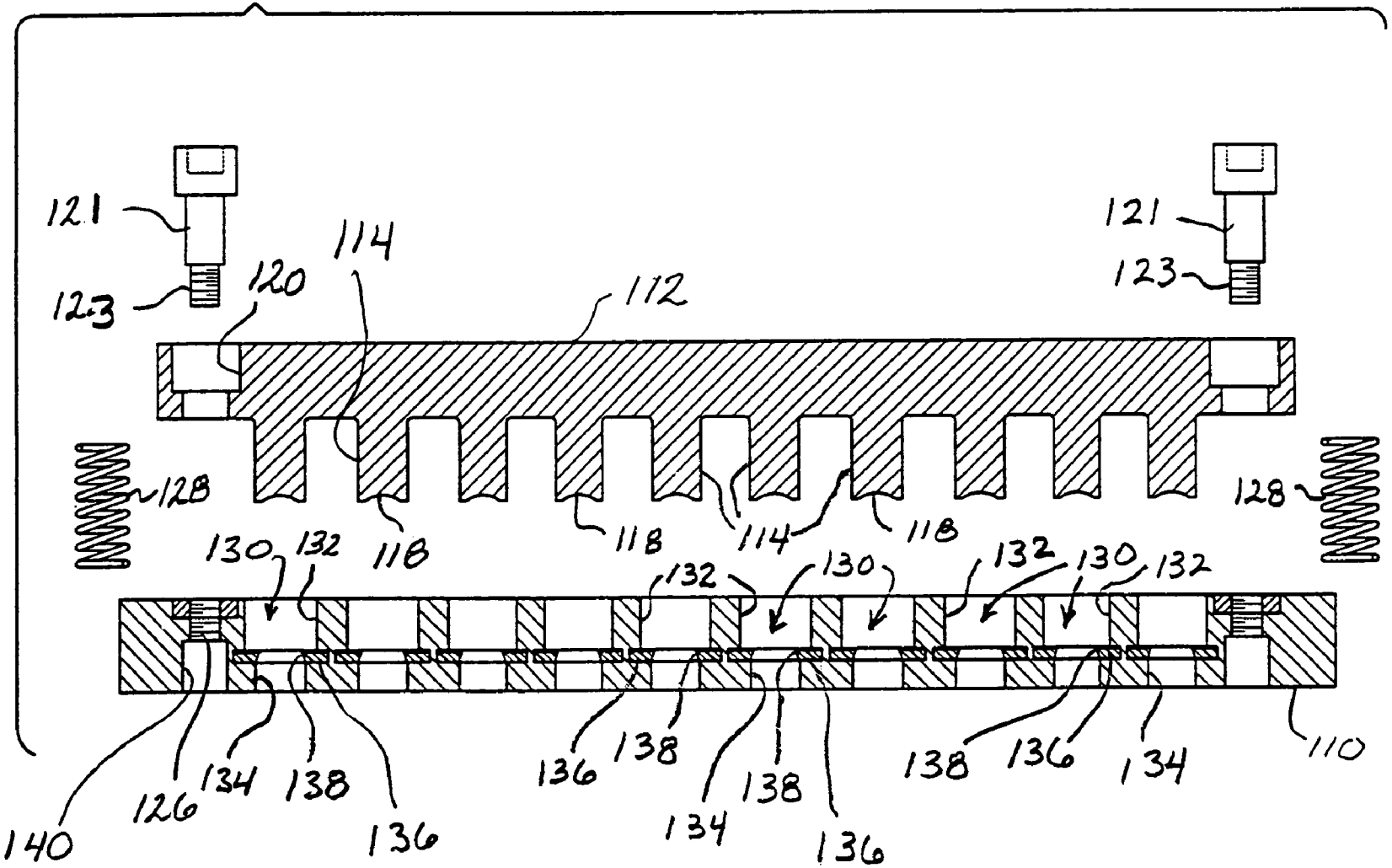
FIG. 12 is an exploded sectional elevational view of the capsule top lift assembly shown in FIG. 10.

As illustrated in FIG. 10, the capsule top lift assembly 72 is removably positionable atop the capsule receiving tray 16. The undersurface of the capsule cap retention tray 110 is provided with a pair of linear channels 140, as shown in FIG. 12. The channels 140 are parallel to each other and receive the upper end walls 142 that project upwardly from the capsule receiving tray 16, shown in FIGS. 10 and 19. The channels 140 are deeper than the height of the grooves 142 in order to enable the bottom surface of the capsule cap receiving tray 110 to come into intimate contact with the upper surface of the capsule receiving tray 16.

The top pressure plate 112 is slightly smaller in size than the capsule cap retention tray 110 so as to provide clearance for the feet 108 of the bellcrank levers 102. The bellcrank levers 102 can thereby engage the end margins of the capsule cap retention tray 110 yet the feet 108 clear the ends of the top pressure plate 112 when the levers 102 are rotated upwardly and toward each other from the positions shown in FIGS. 1 and 13 to the raised position shown in FIG. 15.

Figure 19:
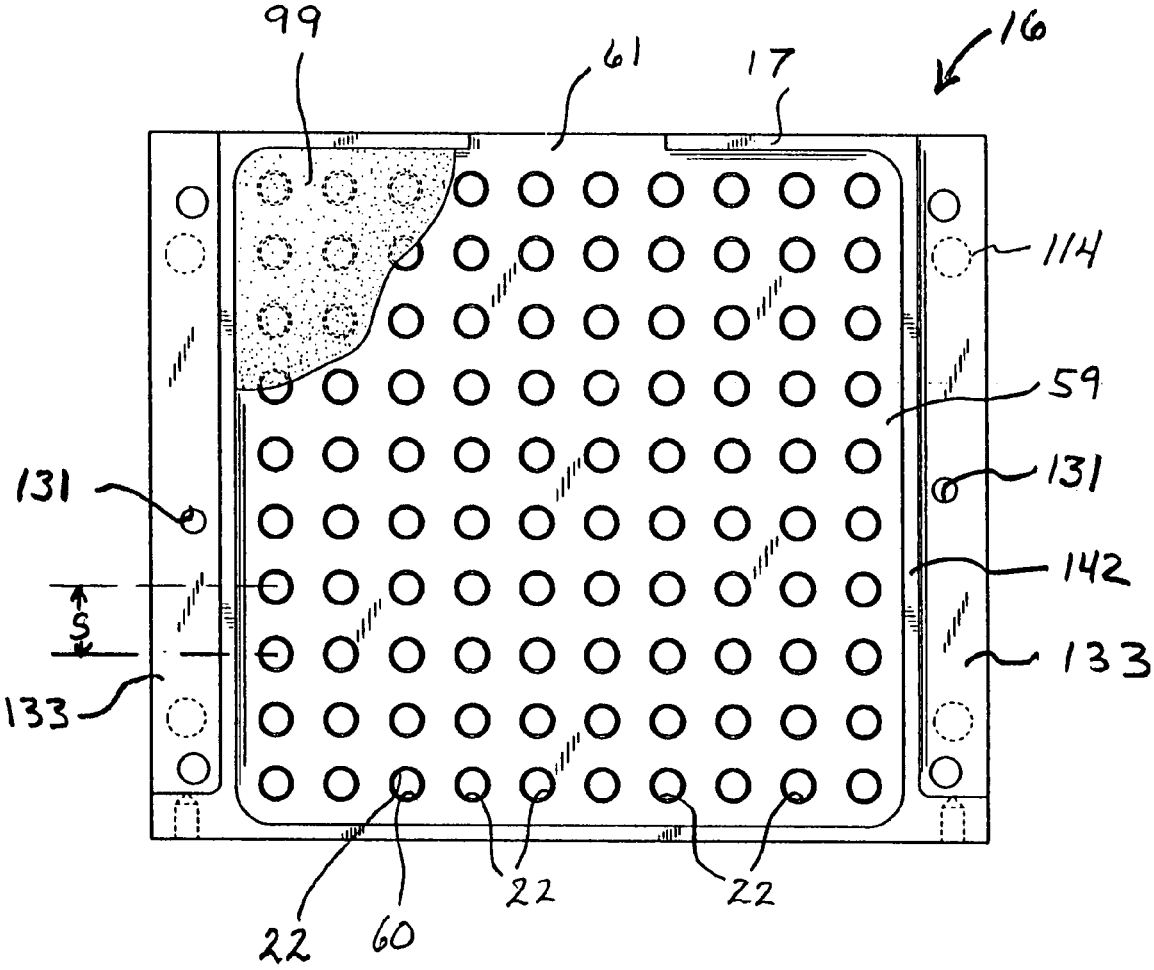
FIG. 19 is a top plan view of the capsule receiving tray of the invention.

The framework 70 is provided with four vertically oriented coil springs 144, one at each corner. The vertically oriented coil springs 114 are illustrated in phantom in FIG. 19 and one of them is visible in FIG. 16. The upper ends of the vertically oriented springs 114 are seated in positioning wells 118 defined in the underside of the capsule receiving tray 16. The lower ends of the vertical springs 114 are similarly seated in upwardly facing positioning wells 120 defined in the structure of the capsule sealing plate 88. The vertically oriented springs 114 are inset slightly from the corners of the capsule receiving tray 16, as illustrated in FIG. 19, and also the capsule body retention tray 68 and the capsule sealing plate 88, which are located vertically beneath the capsule receiving tray 16 and in a parallel orientation relative thereto.

FIG. 16 is a partially broken away elevational view illustrating one of the vertically oriented springs 114. As shown in that drawing figure, the springs 114 pass through apertures 116 defined entirely through the structure of the capsule body retention tray 68. The capsule sealing plate 88 normally rests atop the inwardly directed toes 122 of the framework corner end posts 124 located at the corners of the transverse framework end plates 86, as best illustrated in FIGS. 16 and 22. The capsule sealing plate 88 thereby normally forms a solid base supported by the frame 70 and located by the guide pins 129. The compressed coil springs 114 normally bias the cap receiving tray 16 upwardly relative to the framework 70. The vertically oriented springs 114 project upwardly from the sealing plate 88, through the openings 116 in the capsule body retention plate. The springs 114 thereby normally bias the capsule receiving tray 16 up away from both the capsule body retention tray 68 and the capsule sealing plate 88 unless forces are exerted to compress them.

The bellcrank lever mechanisms 102 are joined to the framework 70 and are operable against the force of the vertical biasing springs 114. The lever mechanisms 102 are operable to entrap the capsule cap retention tray 110 directly atop and in face to face contact with the capsule receiving tray 16. The bellcrank lever mechanisms 102 can be used to overcome the force of the springs 114 so as to press the capsule cap retention tray 110 and the capsule receiving tray 16 together toward the capsule body retention tray 68 by collapsing the tray support linkage 90.

The capsule cap retention tray 110 is positionable directly atop the capsule receiving tray 16. The capsule cap retention tray 110 has capsule cap receiving holes 130 therein equipped with capsule cap grasping rings 136. The grasping rings 136 exert less frictional force against movement of the capsule caps 20 therethrough in a direction away from the capsule receiving tray 16 than in a direction toward the capsule receiving tray 16.

The capsule separation assembly 14 is further comprised of guide pins 129 which are positioned at locations parallel to the framework end plates 86 approximately midway between the framework corner support posts 124 at the ends of the framework end plates 86. The guide pins 129 pass through and are secured to the capsule body retention tray 68. The guide pins 129 project upwardly and their upper extremities are visible through the guide pin openings 131 in the end flanges 133 of the capsule receiving tray 16, shown in FIG. 19.

Figure 14:
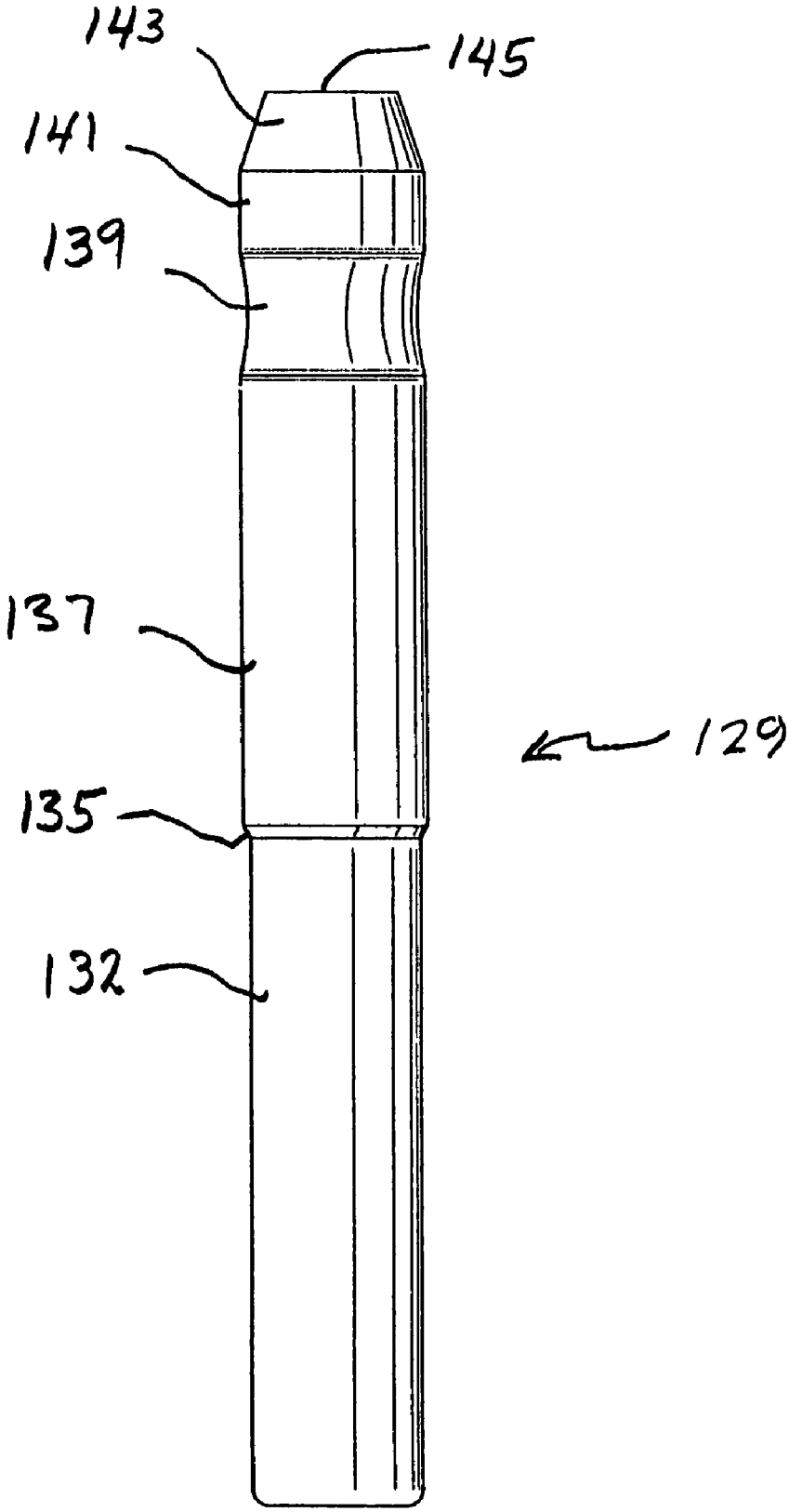
FIG. 14 is a detail elevational view showing in isolation one of the guide pins employed in the capsule separation assembly of the invention.

FIG. 14 is a side elevational view illustrating in detail a single one of the guide pins 129. The guide pins 129 are generally cylindrical in shape and have a lower end 132 that is 0.174 inches in diameter. There is an annular, frustoconical transition 135 from the lower end 132 of the guide pin 129 to the midsection 137 thereof. The guide pins 129 are all solidly anchored to the capsule body retention tray 68 at the transition 135. The angle of inclination of the transition section is thirty degrees relative to the axial alignment of the guide pin 129. The midsection 137 of the guide pin 129 is 0.188 inches in diameter.

At the upper termination of the midsection 137 there is a neck 139 defined in the guide pin 129. The neck 139 has central diameter of 0.174 inches with a radius of curvature to the midsection 137 of 0.032 inches.

Above the neck 139 the guide pin 129 widens to form an upper section 141 having a diameter of 0.188 inches. Above the upper section 141 the guide pin 129 narrows with a frustoconical incline of seventeen degrees relative to the axial alignment of the guide pin 129 to form a nose surface 143. The top 145 of the guide pin 129 has a diameter of 0.136 inches.

The dimensions of the guide pin 129 are quite important for ensuring proper vertical alignment of the various components of the capsule separation assembly 14 during movement of different components thereof. The guide pins 129 and the scissors linkage 90 maintain the capsule retention tray 68 and the capsule receiving tray 16 parallel to each other when the capsule receiving tray 16 is pushed toward the capsule retention tray 68. A nonparallel, noncongruent condition between these trays would cause binding and misalignment between them.

The framework 70 is provided with four push rod mounting blocks 146 located just inboard the framework corner end posts 124, as illustrated in FIG. 1. The push rod mounting blocks 146 have vertical guide bores defined therethrough. Although illustrated as separate structures, the push rod mounting blocks 146 can be formed as portions of the end plates 70. Push rods 148 are disposed within the guide bores for vertical reciprocal movement therewithin. The cylindrical push rods 148 are captured so that they will not drop out of the bores through the push rod mounting blocks 146 by means of split expansion rings 150. The rings 150 are secured by spring tension in radially outwardly facing channels near the lower extremities of the push rods 148, as indicated in the detail view of FIG. 16.

Directly beneath the push rods 148 there are rocker arms 152 mounted for rotation about horizontal axes of rotation by means of bolts 154 that pass through transverse bores through the rocker arms 152. Each of the rocker arms 152 has a force application end 156 projecting out away from the frame 70, and an opposite force transmission end 158 that projects inwardly and resides directly beneath the ends of the capsule sealing plate 88, as best illustrated in FIG. 16.

Figure 13:
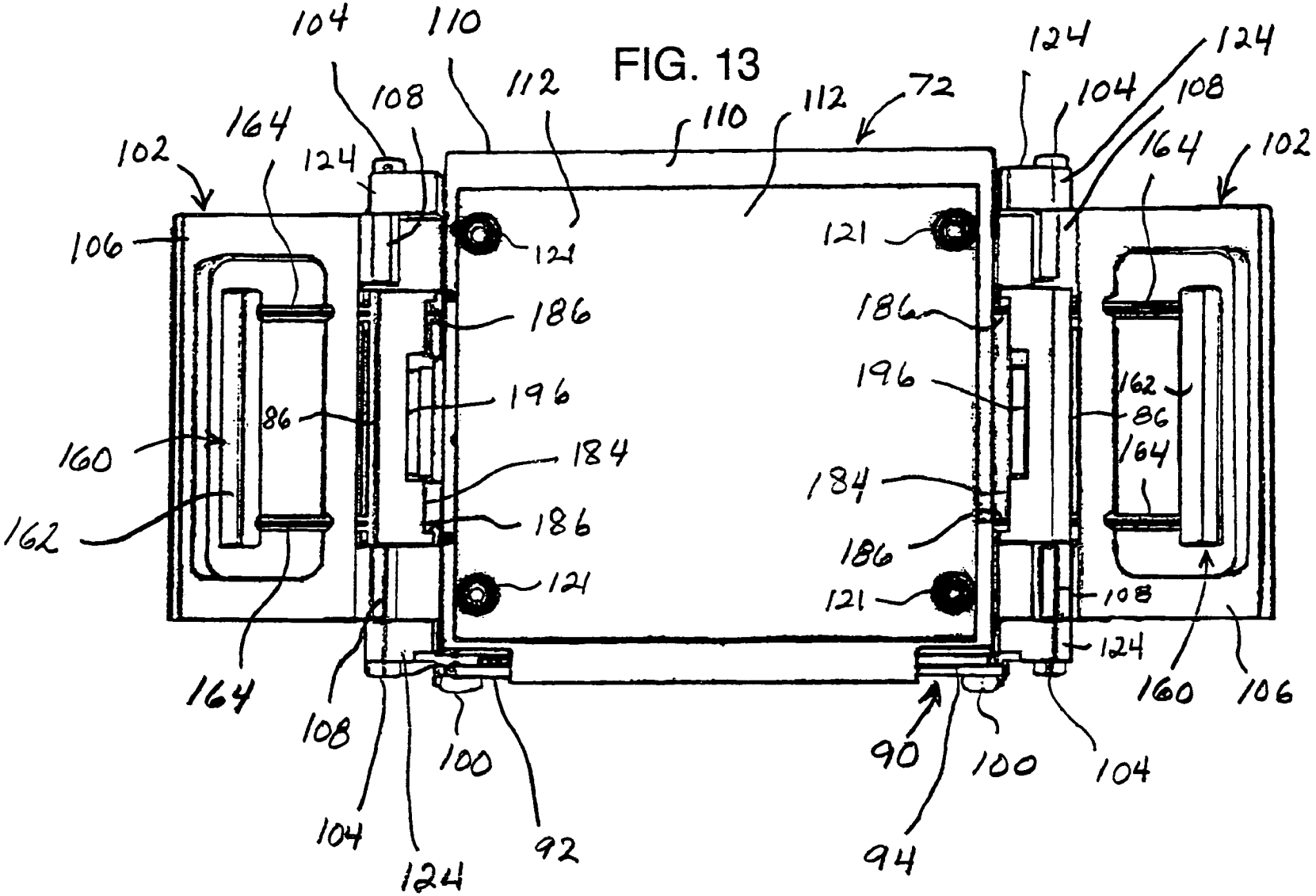
FIG. 13 is a top plan view of the capsule separation assembly shown with the capsule lift assembly in position prior to separation of the capsule caps from the capsule bodies.

The framework 70 is also provided with a pair of releaseable latches 160, visible in FIG. 1, but more clearly illustrated in FIGS. 13 and 15. The latches 160 are each formed with a transverse, cylindrical rod 162 from which a pair of laterally spaced latching pins 164 extend at right angles relative thereto. The latching pins 164 are anchored to the latch push rod 162 and extend through parallel, horizontally oriented latch pin guide apertures defined through the structure of the framework end plates 86 near the upper extremities thereof. Roll pins are pressed into transverse apertures through the tips of the latch pins 164 remote from the push rods 162. The roll pins project beyond the outer diameter of the latch pins 164 and thereby prevent complete withdrawal of the latches 160 from the framework 70. That is, the tips of the latch pins 164 remote from the push rods 162 will not pass through the latch pin guide apertures in the framework end plates 86.

The capsule sealing plate 88 is provided with a multiplicity of upwardly projecting ram posts 166, one of which is visible in FIGS. 27-30. The ram posts 166 are vertically and coaxially aligned with both the capsule body retaining openings 80 in the capsule body retention tray 68 and also with the capsule receiving apertures 60 in the capsule receiving tray 16. The upper tips 168 of the ram posts 166 are formed with arcuately curved, upwardly facing concave surfaces 168, the curvature of which confirms to the curvature of the lower ends 21 of the capsule bodies 22.

Figure 21:
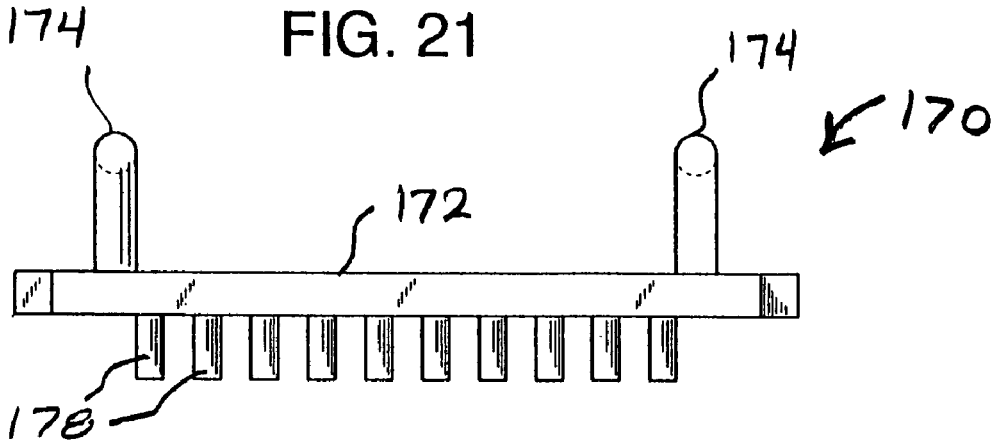
FIG. 21 is a side elevational view of the tamping plate of the invention.
Figure 20:
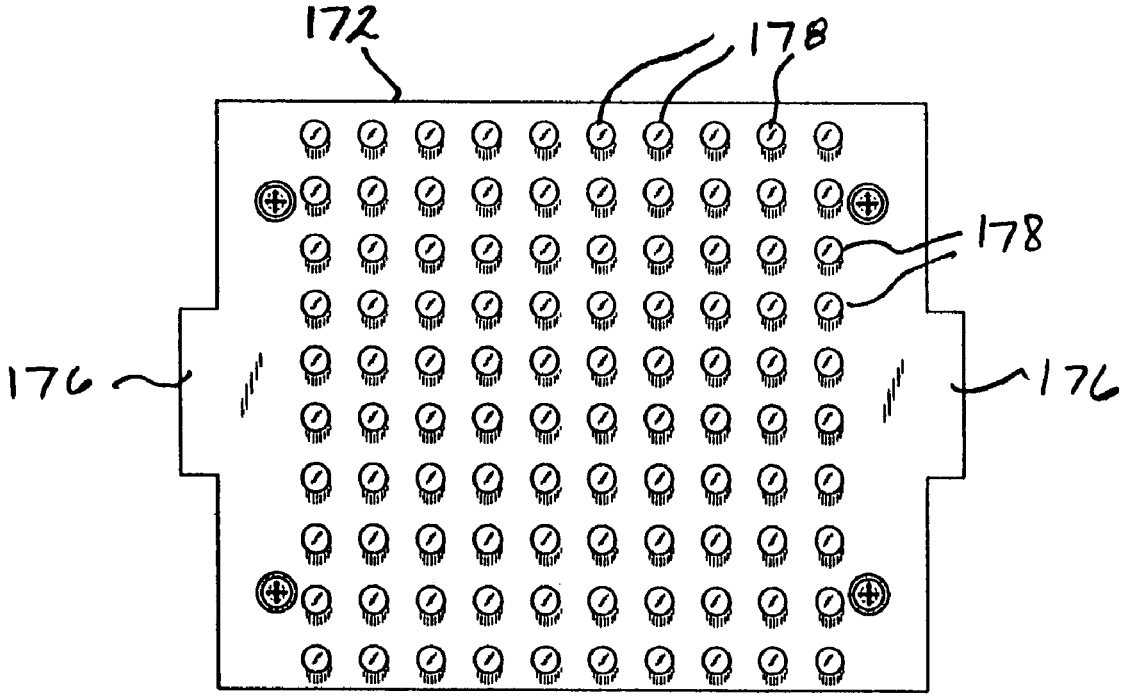
FIG. 20 is a bottom plan view of the tamping plate of the invention.

The apparatus of the invention is also preferably provided with a tamping device 170, illustrated in FIGS. 20 and 21. The tamping device 170 is comprised of a flat steel tamping plate 172 having a pair of U-shaped handles 174 projecting upwardly perpendicular thereto at the opposing ends of the steel tamping plate 172. The tamping plate 172 has a pair of positioning lugs 176 at its opposing ends that fit into corresponding shallow channels 196 in the interior faces at the upper extremities of the framework end plates 86. The positioning lugs 176 ensure proper alignment of the tamping plate 172 relative to the capsule receiving tray 16.

The underside of the tamping plate 172 is provided with a matrix of right cylindrical tamping posts 178 which are located in coaxial alignment with the corresponding capsule receiving apertures 60 when the tamping assembly 170 is properly positioned atop the capsule receiving tray 16. The diameter of each of the tamping posts 178 is just slightly smaller than the inner diameter of each capsule body 22.

The operation of the capsule separation assembly may be described as follows. Once all of the capsule shells 18 have been dropped into the capsule receiving apertures 60 from the capsule orienting apparatus 12, as previously described, the capsule orienting apparatus 12 is removed from atop the capsule receiving tray 16, as illustrated in FIG. 1. All of the capsule shells 18 at this stage are still in their separable state. That is, the capsule caps 20 are fitted telescopically onto the open upper ends of the capsule bodies 22, but the upper ends 19 of the capsule bodies 22 are not pushed past the radially inwardly directed ribs 24 of the capsule caps 20.

After all of the drop apertures 32 of the upper alignment plate 30 have been filled with capsule shells 18 in a separable condition, and following actuation of the capsule rectifying plate 40 to drop the capsule shells 18 into the capsule receiving tray 16, as illustrated in FIGS. 7, 8, and 9, each of the capsule receiving apertures 60 in the capsule receiving tray 16 will contain a single capsule shell 18. Each capsule shell 18 is oriented with the capsule cap 20 atop the capsule body 22 and with the lower edge of the capsule cap 20 resting atop the flat, perforated floor 59 of the capsule receiving tray 16. Only a single one of the capsule receiving apertures 60 is shown as occupied by a capsule shell 18 in FIG. 9 to allow greater clarity of illustration of the capsule receiving tray 16 and the capsule body retention tray 68. However, it is to be understood that each of the one hundred capsule receiving apertures 60 contains a separate capsule shell 18, oriented as illustrated at the second aperture 60 from the left of FIG. 9.

It is then necessary to separate the capsule caps 20 from the capsule bodies 22. Separation of the capsule caps 20 from the capsule bodies 22 is performed utilizing the capsule separation unit. To commence the separation process the capsule top lift assembly 72 is lowered into position onto the capsule receiving tray 16, as illustrated in FIG. 10. The undersurface of the capsule cap retention tray 110 is configured so that the central, generally square portion of it between the channels 140 will just fit within the confines of the boundary rim 17 formed about the floor 59 containing the matrix of capsule receiving apertures 60 in the capsule receiving tray 16.

Figure 27:
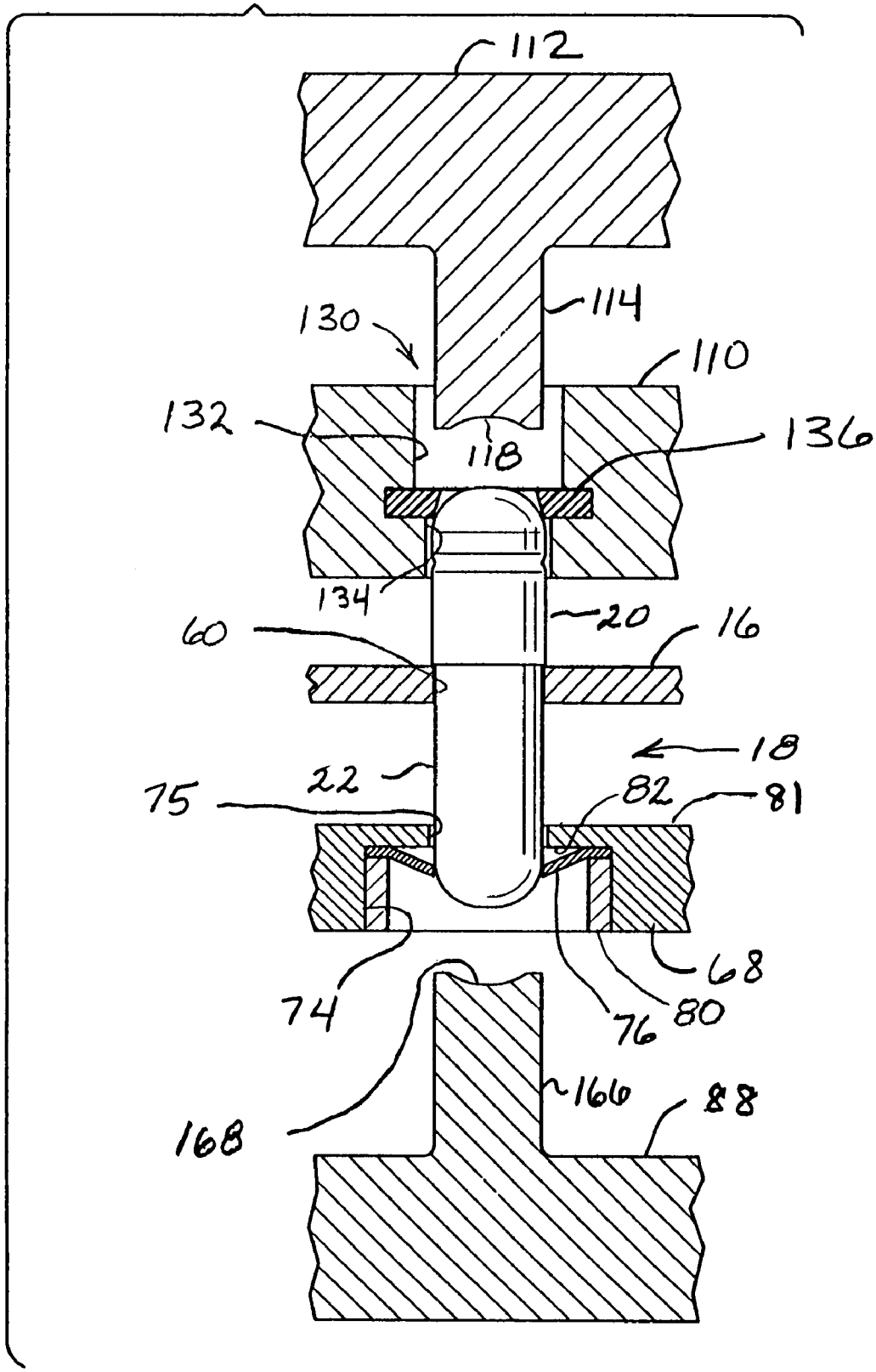
FIG. 27 is an enlarged sectional elevational view of a single capsule shell in the capsule separation assembly of the invention shown as the capsule top lift assembly first approaches the capsule receiving tray.

FIG. 27 is a detail view illustrating the relationship between a single capsule shell 18 and the aligned apertures of the capsule separation assembly 14 as the capsule top lift assembly 72 is lowered onto the capsule receiving tray 16. As the capsule cap retention tray 110 is moved into contact with the capsule receiving tray 16, as shown in FIG. 18, the capsule cap grasping rings 136 are supple enough to permit passage of the upper portion of the capsule cap 20 therethrough.

It is the circumferential annular abutment ridge formed by the difference in diameter between a cap 20 and its body 22 bearing on the plate 16 that forces the cap 20 into upper plate assembly 72, hence the need for low admission friction of ring 136 as the gelatin or cellulose material used in capsule manufacture is weak and subject to fracture, and the available bearing area against the surface 59 of the capsule receiving tray 16 is small. At this point, the bottom end 21 of the capsule body 22 is in the vicinity of the gripper 76, but the capsule body 22 has yet to be engaged. After having been pressed home by hand with enough force to cause the lower surface of the capsule cap retention tray 110 to come in contact with the upper surface 59 of the capsule receiving tray 16, if the top plate assembly 72 is removed, the unseparated capsules will be withdrawn with it. It is true that if the length of the capsule cap 20 is short enough, it may be pressed further into the upper capsule cap retention tray 110 cavity by virtue of the force of engagement between the capsule body 22 and the gripper ring 76. However, this effect is not of primary importance. Because cap lengths vary from manufacturer to manufacturer, the cavity formed by the capsule cap retention tray 110 and the sealing plate 112 must be deep enough to accommodate the longest caps 20 while allowing the ends of the capsule caps 20 to be flush with the bottom surface of the capsule cap retention tray 110.

Figure 28:
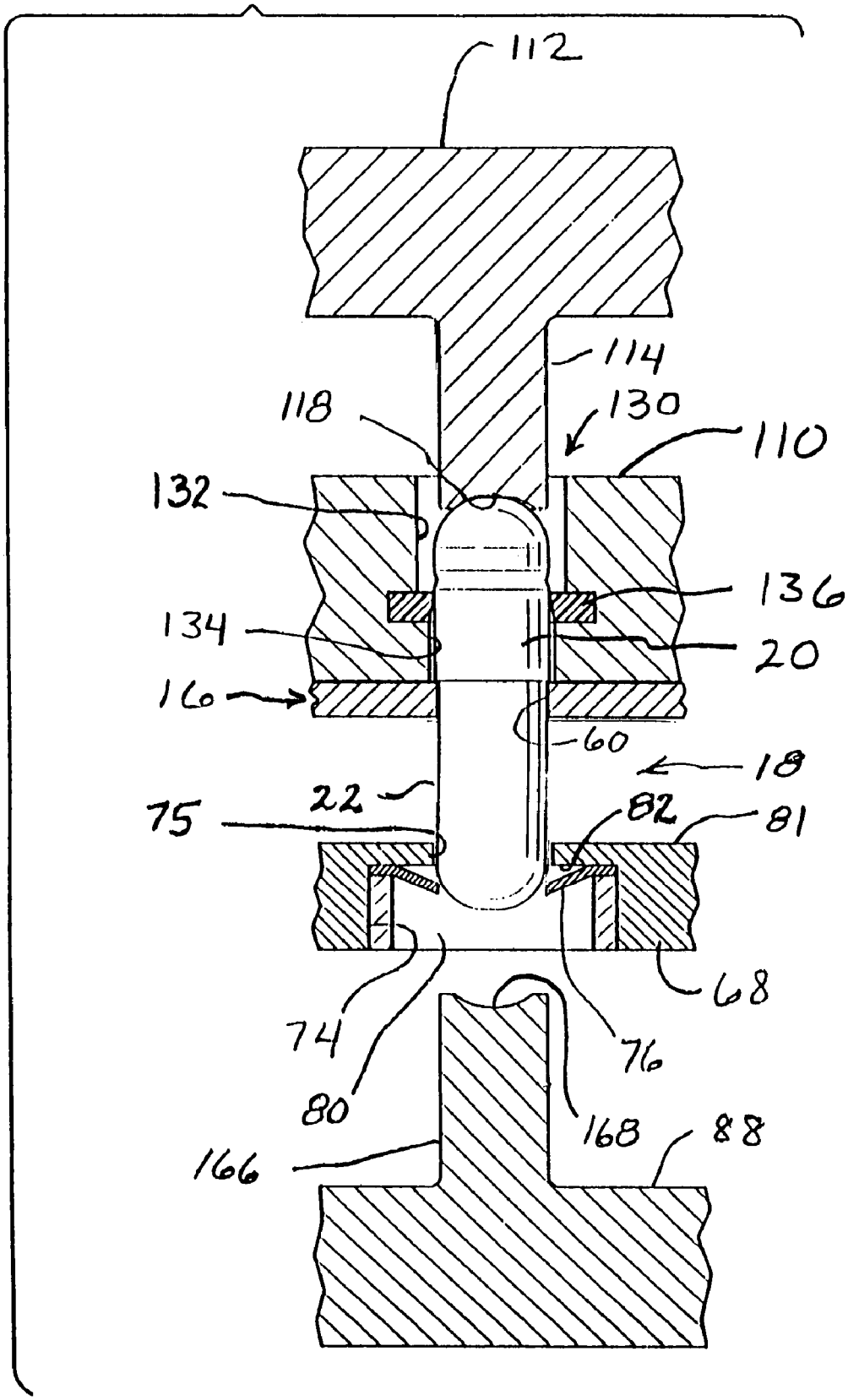
FIG. 28 is an enlarged sectional elevational view of a single capsule shell in the capsule separation assembly of the invention shown with the top lift assembly resting on the capsule receiving tray.

When the capsule cap lift assembly 72 is lowered into position, as illustrated in FIG. 28, the capsule cap bearing posts 114 depending from the underside of the capsule cap sealing plate 112 reside just above, or slightly in contact with the rounded upper ends 23 of the capsule caps 20, as illustrated in FIG. 28. However, at this point in the separation process, the capsule cap bearing posts 114 do not exert any pressure on the top surfaces 23 of the capsule caps 20.

Once the capsule top lift assembly 72 has been placed upon the capsule receiving tray 16 so that the undersurface of the capsule cap retention tray 110 resides in contact with the exposed upper surface of the capsule receiving tray 16, the capsule caps 20 are lightly engaged with the capsule cap retention tray 110 by virtue of the light frictional grip exerted on them by the capsule cap grasping rings 136. FIG. 13 illustrates the capsule top lift assembly 72 positioned atop the capsule receiving tray 16. However, a further step is necessary in order to ensure that the capsule bodies 22 remain in position in the capsule receiving tray 16 before the capsule top lift assembly 72 can be removed.

As illustrated in FIG. 15, with the capsule top lift assembly 72 positioned atop the capsule receiving tray 16, the bellcrank lever mechanisms 102 that are rotatably mounted relative to the framework end post 124 are rotated upwardly and toward each other. The bellcrank levers 102 are operated by manually grasping the U-shaped lever arm handles 106 formed at the outboard ends of the bellcrank levers 102 and lifting them up concurrently, as illustrated in FIG. 15.

The upward rotation of the bellcrank levers 102 causes the feet 108 thereof to press downwardly upon the marginal edges of the ends of the capsule cap retention tray 110. Since the capsule cap sealing plate 112 is slightly smaller than the capsule cap retention tray 110, the springs 128 continue to hold the capsule cap sealing plate fully elevated above the capsule cap retention tray 110 so that no downward force is exerted directly on the capsule caps 20. To the contrary, the downward force is exerted by the bellcrank levers 102 when actuated as illustrated in FIG. 15 to concurrently force the capsule body retention tray 110 and the capsule receiving tray 16 beneath it together toward the capsule body retention tray 68 in the manner illustrated in FIG. 29. The downward stroke of the bellcrank levers 102 is stopped when the approaching capsule receiving tray 16 contacts capsule body retention tray 68 in such a manner that essentially no distance of separation exists between the bottom surface of the capsule receiving tray 16 and the top surface 81 of the capsule body retention tray 68, as illustrated in FIG. 30.

Figure 29:
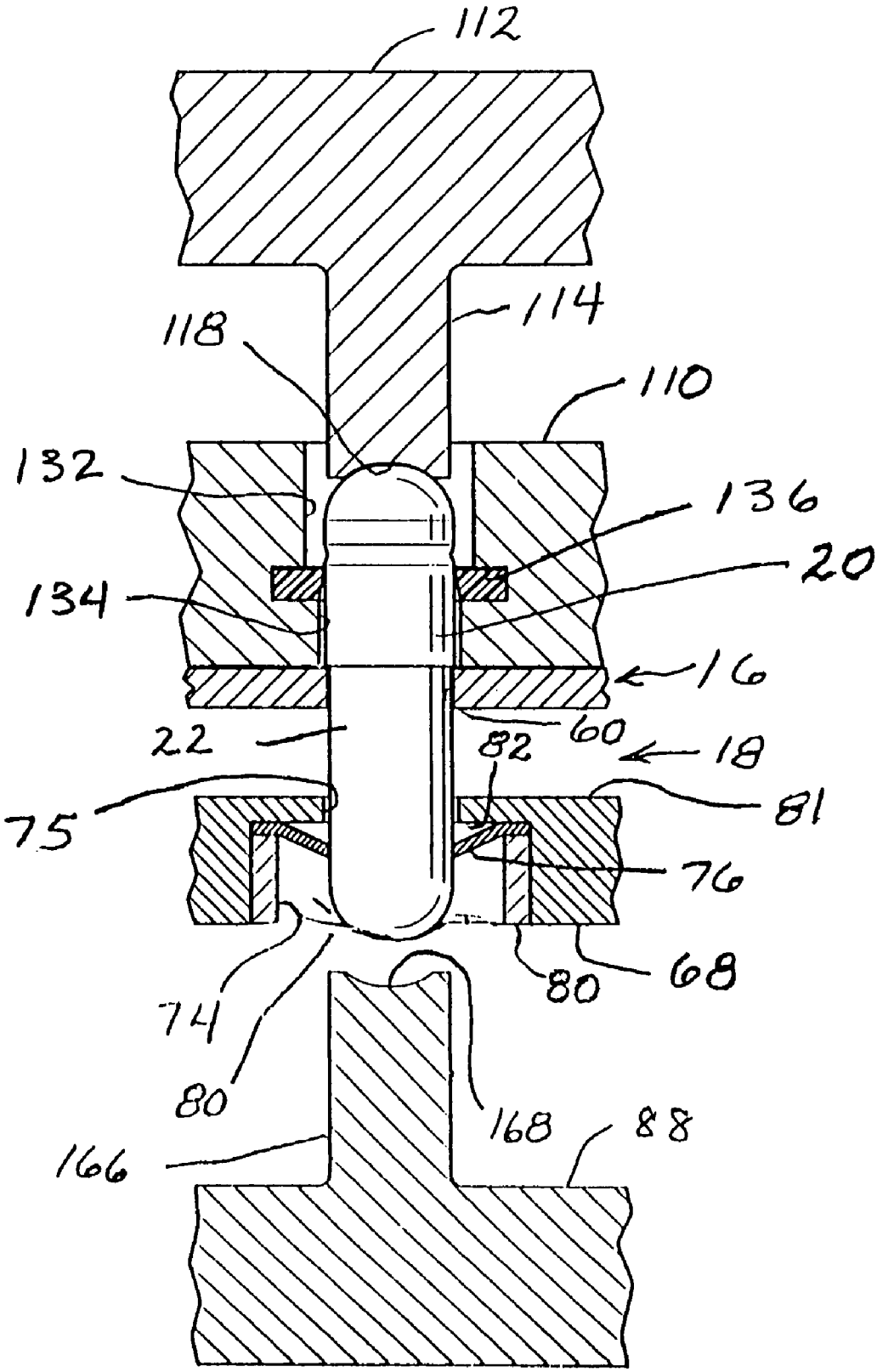
FIG. 29 is an enlarged sectional elevational view of a single capsule shell in the capsule separation assembly of the invention shown with the top lift assembly and capsule receiving tray being pressed toward the capsule body retention tray.
Figure 30:
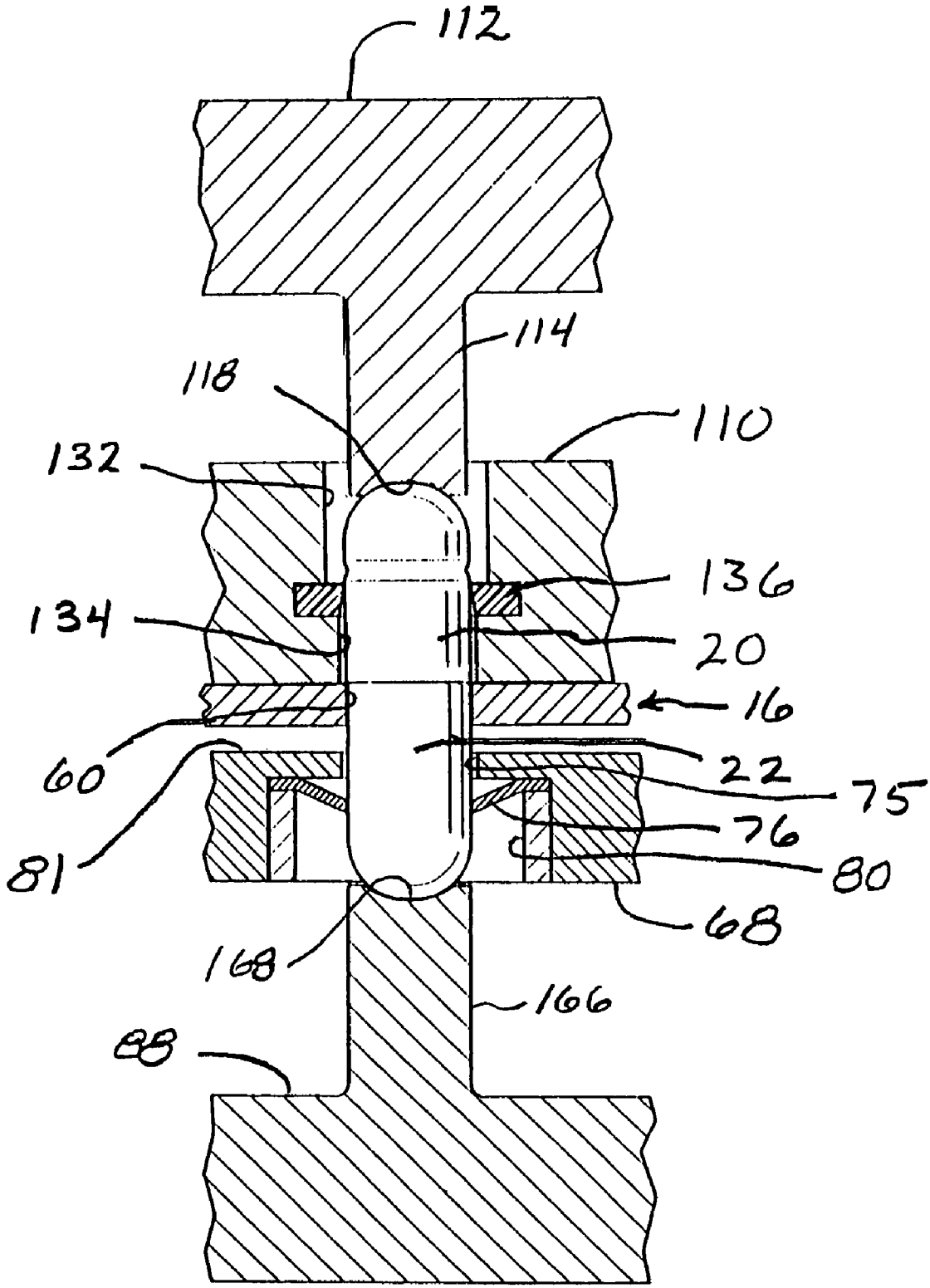
FIG. 30 is an enlarged sectional elevational view of a single capsule shell in the capsule separation assembly of the invention shown with the top lift assembly and capsule receiving tray being pressed toward the capsule body retention tray and with the capsule sealing plate being forced upwardly toward the capsule body retention tray.

As shown in FIG. 29, the downward movement of the capsule receiving tray 16 and the capsule cap receiving tray 110 toward the capsule body retention tray 68 causes the capsule body 22 to be pushed further into the capsule body receiving opening 80 of the capsule body retention tray 68. That is, the capsule body retaining flanges 78 are sufficiently resilient to deflect downwardly to the extent illustrated in FIG. 29. Downward movement of the capsule receiving tray 16 and the capsule cap receiving tray 110 by the force applied through the bellcrank levers 102 partially compresses the coil springs 114 to allow the capsule receiving tray 16 to be pushed closer to the capsule body retention tray 68, as illustrated in FIG. 29. The downward movement of the capsule body 22 is such that the lower end 21 of the capsule body 22 resides just above, or barely in contact with the concave upwardly facing surfaces 168 of the ram posts 166 which project upwardly from the sealing plate 88.

At this point in the separation process, the capsule cap grasping rings 136 lightly grip the capsule caps 20, while the capsule body gripping rings 76 lightly grip the capsule bodies 22. The capsule top lift assembly 72 can then be lifted free from the capsule receiving tray 16, as shown in FIG. 10. As the capsule top lift assembly 72 is removed, it carries with it all of the capsule caps 20 engaged by the capsule grasping rings 136 in the capsule cap retention tray 110. The capsule gripping rings 76 hold the capsule bodies 22 within the capsule body retention tray 68. The capsule top lift assembly 72 is then set aside for the moment.

When the downward force applied by the bellcrank levers 102 is released, and the bellcrank levers 102 are returned to the conditions illustrated in FIGS. 1 and 13, the coil springs 114 push the capsule receiving tray 16 back up to its rest position as determined by projections formed in side plates 70. At this point, since the capsule bodies 22 remain stationary, the top surface of capsule receiving tray 16 is flush with, or slightly above, the upper edges 19 of the capsule bodies 22. The total travel of the capsule receiving tray 16 is calculated to ensure that (1) each capsule body 22 is fully engaged with its gripper 76, and (2) that the upper edges 19 of the capsule bodies will not project above the floor 59, thereby interfering with the uniform spreading of filler material. The grippers 76 must be allowed to float in their retaining pockets in order to maintain axial alignment with the capsule bodies. However, they must not be allowed to have much lateral movement in order to ensure that the capsule bodies 22 are not partially withdrawn as a result of the friction exerted by the capsule receiving tray 16 during its migration back to its rest position, and the frictional forces caused by removal of the caps 20 from the bodies 22.

With the capsule top lift assembly 72 removed from atop the capsule receiving tray 16, the upper ends 19 of the capsule bodies 22 reside in flush, coplanar relationship with the upper, horizontal floor surface of the capsule receiving tray 16. A quantity of medicament, vitamin material, or other contents with which the capsule shells 18 are to be filled is then poured onto the flat, horizontal surface 59 of the capsule receiving tray 16. The capsule filler material is normally a powdered substance 99 which will flow freely into the open mouths of the capsule bodies 22. Any excess material is swept off of the floor 59 through the gate opening 61 on one side of the boundary rim 17 of the capsule receiving tray 16.

It is then usually advisable to tamp down the capsule filler material into the capsule bodies 22. The tamping assembly 170 is employed for this purpose.

The tamping assembly 170 is positioned directly over the capsule receiving tray 16, once the capsule bodies 22 have been filled with capsule filler material and lowered into position. The end positioning lugs 176 of the tamping plate 172 are guided by the guide opening slots 196 in the inwardly facing surfaces of the upper extremities of the framework end plates 86. The tamping rods 178 fit smoothly within the circular open mouths of the capsule bodies 22 so that the capsule filler material can be easily tamped down.

The tamping device 170 is then removed and the capsule top lift assembly 72 replaced atop the capsule receiving tray 16 in the manner previously described. At this point in the process it is necessary to seal the capsule shells 18.

The first step in the capsule sealing process is to again raise the bellcrank levers 102 from their relaxed, normal, horizontally extending positions illustrated in FIGS. 1 and 13, to their raised positions illustrated in FIG. 15. This rotation of the bellcrank levers 102 again compresses the coil springs 114 and pushes the capsule cap receiving tray 110 and the capsule receiving tray 16 together downwardly toward the capsule body retention tray 68, to the position illustrated in FIG. 30. At this point it is necessary to latch the capsule cap receiving tray 110 and the capsule receiving tray 16 in the depressed condition illustrated in FIG. 15. To do this the releaseable latches 160 are employed.

The latch bars 162 are pressed toward each other, thereby carrying the latch pins 164 through the latching pin guide bores near the upper edges of the framework end plates 86. The tips of the latch pins 164 thereupon project out over the upper edges of the capsule cap retention tray 110, thereby holding the capsule receiving tray 16 in the condition depressed toward the capsule body retention tray 68. The components will thereupon reside in the dispositions illustrated in FIG. 30.

The bellcrank levers 102 are then released to their relaxed, normally horizontal orientation as illustrated in FIG. 22. However, as also shown in that drawing figure, the scissors linkage 90 has been collapsed and the springs 114 are held in a partially compressed condition, since the latch pins 164 project out over the edges of the capsule cap receiving tray 110 and prevent the capsule top lift assembly 72 from rising.

The capsule sealing plate 88 is disposed horizontally and is oriented perpendicular to the framework end plates 86. The capsule sealing plate 88 normally rests atop the toes 122 of the framework end corner posts 124. However, in order to seal the capsule shells 18, the capsule sealing plate 88 must be raised.

The bellcrank levers 102 are then counterrotated downwardly as illustrated in FIG. 24. The downward force on the bellcrank lever handles 108 forces the sealing force transmissions push rods 148 downwardly from the positions illustrated in FIG. 16. The lower extremities of the push rods 148 are pressed downwardly against the outboard ends 156 of the rocker arms 152, thereby causing the inboard ends 158 of the rocker arms 152 to be pressed upwardly against the opposing force of the springs 114. This upward force against the underside of the sealing plate 88 lifts the sealing plate 88 and causes the ram posts 166 to be forced upwardly from the positions shown in FIG. 29.

The sealing plate 88 is pressed upwardly, thereby forcing the capsule bodies 22 up into the capsule caps 20, as illustrated in FIG. 30. The upward movement of the capsule bodies 22 relative to the capsule caps 20 caused by the counterrotation of the bellcrank levers 102 forces the upper edges 19 of the capsule bodies 22 upwardly past the radially inwardly projecting ribs 24 in the interior walls of the capsule caps 20. Upward movement proceeds until the ribs 24 in the inner walls of the capsule caps 20 engage the grooves 25 formed in the outer walls of the capsule bodies 22. Once the ribs 24 engage the grooves 25, the capsule caps 20 are firmly secured to the capsule bodies 22 and are tightly and permanently sealed thereto. The capsule shells 18 are thereupon all in the sealed state or condition.

Concurrently with the sealing of the capsule caps 20 relative to the capsule bodies 22, the bottom ends 21 of the capsule bodies 22 are pushed upwardly relative to the capsule gripping apertures 80 of the capsule body retention tray 68 to a sufficient extent that they again rest atop the capsule support flanges 78. Normally, once the capsules have been assembled in their locked positions, the capsule bodies still remain engaged with gripper rings 76. Also, the frictional drag exerted on the capsule walls of by the gripper rings 76 is relatively large. The gripper rings 76 play a very important part in the operation of the machine of the invention. The function that they perform is absolutely vital. This is why the gripper rings 76 are made of thin stainless steel, rather than rubber, which has an uneven performance. The machine of the invention works because the frictional force of the capsule body 22 entering the gripper ring 76 is substantially less than the force required to lock the capsule parts together. Also, because the frictional force of the gripper 76 restraining the capsule body 22 is substantially greater than the force required to separate the capsule cap 20 from the capsule body 22, the capsules 18 will separate when the top plate assembly is removed.

The bellcrank levers 102 are then released from the counterrotation position shown in FIG. 24 and rotated back up toward each other to the positions illustrated in FIG. 15. The latching rod handles 162 are then pulled back apart from each other, as illustrated at 162' in FIG. 15. Once the latches 160 have been pulled out away from the frame 70, the latch pins 164 no longer project atop the upper, outboard edges of the capsule cap retention tray 110.

The capsule top lift assembly 72 can now be withdrawn from atop the capsule receiving tray 16. With the capsule top lift assembly 72 removed from the capsule receiving tray 16, the plate 112 is pressed to eject the sealed capsules 18 that are now ready for packaging. Alternatively, if the top lift assembly 72 is difficult to remove, the side levers 102 can be rotated downwardly as shown in FIG. 24 in order to overcome the cumulative friction of the capsule body gripping rings 76 that exceed the return force of springs 114.

The process of capsule separation for filling may be summarized as follows. The apparatus of the invention may be used to separate a multiplicity of oblong capsule shells 18 which are in a separable state. The capsule shells 18, in their separable state, are first oriented upright utilizing the capsule orienting unit 12 and are dropped into a capsule receiving tray 16 having a matrix of circular capsule receiving apertures defined therein. A capsule body retention tray 68 is positioned directly beneath the capsule receiving tray. Each of the capsule bodies 22 is located directly above a separate capsule retaining apertures 80 containing a capsule body gripping ring 76 in the capsule body retention tray 68. The capsule body gripping rings 76 exert less frictional force against the movement of the capsule body therethrough and away from the capsule receiving tray 16 than in a direction toward the capsule receiving tray 16.

A capsule cap retention tray 110 is located directly atop the capsule receiving tray 16. The capsule cap retention tray 110 has capsule cap receiving holes 130 therein equipped with capsule cap grasping rings 136. The rings 136 exert less frictional force against movement of the capsule caps 20 therethrough in a direction away from the capsule receiving tray 16 than in a direction toward the capsule receiving tray 16.

The capsule cap retention tray 110 and the capsule receiving tray 16 are pressed together toward the capsule body retention tray 68. The capsule bodies 22 are advanced into the capsule body gripping rings 76 and the capsule caps 20 are advanced into the capsule cap grasping rings 136.

The capsule body retention tray 68 is located beneath the capsule receiving tray 16 and has capsule body retaining openings 74 with capsule body gripping rings 76 therein. The capsule body gripping rings 76 are formed as thin metal discs having central cruciform openings 77 defined therein. These openings are formed with capsule body retaining flanges 78 directed at an inclination out of the plane of the periphery of the gripping rings 76 and away from the capsule receiving plate 16. The capsule body gripping rings 76 frictionally grip capsule bodies 22 received therein. The capsule body gripping rings 76 provide greater resistence to movement through their openings 77 in a direction toward the capsule receiving tray 16 than in a direction away from the capsule receiving tray 16.

The capsule body retention tray 68 and the capsule receiving tray 16 are maintained parallel to each other by a framework 70. The capsule sealing plate 88 is located beneath the capsule body retention tray 16. The framework 70 is provided with a tray support linkage 90, which is a scissors linkage, that collapses to permit movement of the capsule receiving tray 16 toward the capsule body retention tray 68.

The framework 70 is also provided with bellcrank lever mechanisms 102 joined to the framework 70 and operable against the force of vertically biasing springs 114. The springs 114 are coil springs that pass through openings in the stationary capsule body retention tray 68. The vertical springs 114 have upper ends that exert an upward force against the capsule receiving tray 16 and lower ends that exert a downward force on a capsule body sealing plate 88. The framework 70 is provided with tray support linkage 90, which is a scissors linkage, that collapses to permit movement of the capsule receiving tray 16 toward the capsule body retention tray 68 without binding.

The bellcrank levers are mounted on the framework 70 and are rotatable to push the capsule cap retention tray 110 and the capsule receiving tray 16 together, downwardly toward the capsule body retention tray 68, thereby overcoming the bias of the springs 114. Actuation of the bellcrank levers 102 by rotation of those levers toward each other collapses the capsule cap retention tray 110 and the capsule receiving tray 16 together into a collapsed condition approaching the capsule body retention tray 68. However, the bellcrank levers 102 are also counterrotatable to neutral positions to release the capsule cap retention tray 110.

The capsule cap retention tray 110 is removed from the capsule receiving tray 16. The capsule bodies 22 remain lodged in the capsule body gripping rings 76 and the capsule caps 20 remain lodged in the capsule cap grasping rings 136. This allows the multiplicity of capsule caps 20 to be concurrently separated from the multiplicity of capsule bodies 22.

The process of recoupling the capsule caps 20 to the capsule bodies 22 and permanently sealing them together may be summarized as follows. After the capsule bodies 22 are loaded with a desired capsule filling substance, the capsule cap retention tray 110 is unidirectionally oriented upon the capsule receiving tray 16 guided by a flange projection extending from the back of the capsule cap retention tray 110. The capsule cap retention tray 110 and the capsule receiving tray 16 are then pressed together and toward the capsule body retention tray 68. The capsule bodies 22 are forced upwardly back through and outwardly out of engagement with the capsule body rings 76 while concurrently applying an opposing force against the capsule caps 20. The capsule caps 20 are thereby concurrently replaced back on the capsule bodies 22 and the capsule caps 20 and the capsule bodies 22 are concurrently forced together. The capsule caps 20 and the capsule bodies 22 are thereby permanently engaged with each other and permanently sealed.

The framework 70 is comprised of releaseably engageable latches 160 to hold the capsule cap retention tray 110 and the capsule receiving tray 16 in a collapsed condition. The capsule sealing plate 88 is movable toward the capsule body retention plate 16 to a sealing position and away from the capsule body retention plate 16 to a retracted position.

The capsule sealing plate 88 is provided with a multiplicity of upwardly projecting ram posts 166 aligned with the capsule body retaining openings 80. The capsule framework 70 supports the capsule sealing plate 88 parallel to and beneath the capsule body retention plate 68. Movement of the capsule sealing plate 88 to the sealing position forces the capsule bodies 22 far enough into the capsule caps 20 to permanently seal the capsule bodies 22 to the capsule caps 20.

Sealing lever linkages are also provided and are formed of push rods 148 and rocker arms 152. The sealing lever linkages are located on the framework 70 and are coupled between the capsule sealing plate 88 and the bellcrank levers 102.

Counterrotation of the bellcrank levers 102 beyond their neutral positions with the latches 160 engaged and the capsule cap retention tray 110 and the capsule receiving tray 16 latched by the latches 160 forces the capsule sealing plate 88 to the sealed position. That is, the capsule bodies 22 are pushed by counterrotation of the bellcrank levers 102 up into the capsule caps 20 until the radial sealing ribs 24 of the capsule caps 20 engage the radially outwardly directed sealing grooves 25. The capsule shells 18 are thereupon permanently secured together in a sealed condition of state.

Undoubtedly, numerous variations and modifications of the invention will become readily apparent to those familiar with capsule loading machines. Accordingly, the scope of the invention should not be construed as limited to the specific embodiment depicted nor the implementation of the method described, but rather is defined in the claims appended hereto.

We claim:

1. A manually operated apparatus for uniformly orienting a multiplicity of oblong capsule shells of circular cross section each having a cap fitted telescopically onto a smaller diameter body comprising:

an upper alignment plate forming a capsule orienting tray and defining a matrix of uniformly aligned, oblong, horizontal capsule drop slots therethrough, wherein each of said capsule drop slots has a length and width sufficient to permit passage of said capsules therethrough while in a horizontal disposition, a capsule rectifying plate located directly beneath and parallel to said upper alignment plate and having horizontal capsule rectifying apertures defined therein corresponding to, parallel to, and shaped lengthwise as said capsule drop slots but with opposing ends wider than said capsule bodies and narrower than said capsule caps and midsections wider than said capsule caps, and the ratio of the length of said midsections to the entire length of said capsule rectifying apertures is between about 0.15 and about 0.20 to one, a funnel tray located beneath said capsule rectifying plate and including funnels located beneath said drop apertures and said rectifying apertures and having circular funnel discharge apertures large enough to provide clearance for passage of said capsules therethrough while in a vertical orientation, a capsule receiving tray having circular capsule receiving apertures defined therein and located directly beneath said funnel discharge apertures, and wherein a selected one of said upper alignment and capsule rectifying plates is mounted in laterally reciprocal fashion relative to the other of said plates, alternatively between a capsule discharge position in which said capsule rectifying apertures reside in vertical registration with said capsule drop slots, and a capsule orienting position in which said capsule rectifying apertures are at least partially laterally offset from said capsule drop slots.

2. An apparatus according to claim 1 wherein said ratio of the length of said midsections to entire length of said capsule rectifying apertures is about 0.1836 to one.

3. An apparatus according to claim 1 wherein each of said midsections is about 0.179 inches in length and said entire length of each of said capsule rectifying apertures is about 0.975 inches in length.

4. An apparatus according to claim 1 wherein said upper alignment plate is rigidly secured to said funnel tray and said capsule rectifying plate is mounted for reciprocal movement therebetween.

5. An apparatus according to claim 4 further comprising at least one horizontal spring acting between said upper alignment plate and said capsule rectifying plate to bias said capsule rectifying plate toward said capsule orienting position.

6. An apparatus according to claim 1 wherein said capsule receiving apertures in said capsule receiving tray are each of a diameter larger than the diameter of said capsule bodies and smaller than the diameter of said capsule caps, and wherein said capsule receiving apertures are arranged in corresponding vertical alignment with said funnels and said capsule receiving tray also forms a portion of a capsule separation assembly, and said upper alignment plate, said capsule rectifying plate, and said funnel tray are assembled together as a capsule orienting unit and said capsule orienting unit is removably positionable directly upon said capsule receiving tray.

7. An apparatus according to claim 6 wherein said capsule separation assembly is further comprised of:

a capsule body retention tray located beneath said capsule receiving tray and having capsule body retaining openings with capsule body gripping rings therein that frictionally grip capsule bodies received therein to provide greater resistance to movement therethrough in a direction toward said capsule receiving tray than in a direction away from said capsule receiving tray, a framework that maintains said capsule body retention tray and said capsule receiving tray parallel to each other, a capsule top lift assembly comprising a capsule cap retention tray for positioning directly atop said capsule receiving tray and having capsule cap receiving openings with capsule cap grasping rings therein that permit passage of said capsule caps therethrough and provide greater resistance to movement of said capsule caps therethrough in a direction toward said capsule receiving tray than away from said capsule receiving tray, vertical springs acting between said capsule receiving tray and said capsule body retention tray to bias said capsule receiving tray up away from said capsule body retention tray, levers mounted on said framework and rotatable to push said capsule cap retention tray and said capsule receiving tray together downwardly toward said capsule body retention tray thereby overcoming the bias of said vertical springs and collapse said capsule cap retention tray and said capsule receiving tray together into a collapsed condition approaching said capsule body retention tray, and counterrotatable to neutral positions to release said capsule cap retention tray.

8. An apparatus according to claim 7 further comprising releaseably engageable latches to hold said capsule cap retention tray and said capsule receiving tray in said collapsed condition, and further comprising a capsule sealing plate oriented parallel to and located beneath said capsule body retention tray, and said capsule sealing plate is mounted to said framework for reciprocal movement toward said capsule body retention tray to a sealing position and away from said capsule body retention tray to a retracted position, and said capsule sealing plate is provided with a multiplicity of upwardly projecting ram posts aligned with said capsule body retaining openings, whereby movement of said capsule sealing plate to said sealing position forces said capsule bodies far enough into said capsule caps to permanently seal said capsule bodies to said capsule caps.

9. An apparatus according to claim 8 further comprising a sealing lever linkage on said framework coupled between said capsule sealing plate and said levers and guide pins secured to said capsule body retention tray and projecting through said guide pin openings in said capsule receiving tray and said capsule sealing plate, whereby counterrotation of said levers beyond said neutral positions with said latches engaged and said capsule cap retention tray and said capsule receiving tray in said collapsed condition, forces said capsule sealing plate to said sealing position, and said guide pins have sections of reduced diameter to prevent them from binding in said guide pin openings.

10. An apparatus according to claim 6 wherein said capsule body gripping rings are formed by resilient disks of metal each having a central cruciform opening defined therethrough.

11. An apparatus according to claim 6 wherein said capsule cap grasping rings are each annular structures formed of rubber with a central circular opening defined therethrough.

* * * * *